US008216507B2

(12) United States Patent
Strelbisky et al.

(10) Patent No.: US 8,216,507 B2
(45) Date of Patent: Jul. 10, 2012

(54) POST-COMBUSTION LANCE WITH INTERNAL SUPPORT

(75) Inventors: Michael J. Strelbisky, Burlington (CA); Kerry J. Legeard, Caledonia (CA); William D. Whyte, Demotte, IN (US)

(73) Assignee: A.H. Tallman Bronze Company, Limited (CA)

( * ) Notice: Subject to any disclaimer, the term of this patent is extended or adjusted under 35 U.S.C. 154(b) by 725 days.

(21) Appl. No.: 12/359,825

(22) Filed: Jan. 26, 2009

(65) Prior Publication Data

US 2009/0189322 A1 Jul. 30, 2009

Related U.S. Application Data

(60) Provisional application No. 61/023,275, filed on Jan. 24, 2008.

(51) Int. Cl.
*C21C 5/30* (2006.01)

(52) U.S. Cl. ..... 266/44; 266/226

(58) Field of Classification Search ..... 266/44, 266/226

See application file for complete search history.

(56) References Cited

U.S. PATENT DOCUMENTS 4,047,936 A 9/1977 Chang
4,083,543 A 4/1978 Berry et al.
4,106,756 A 8/1978 Rymarchyk et al.
4,365,992 A 12/1982 Sieckman
4,732,370 A 3/1988 Berry et al.
5,308,043 A 5/1994 Floyd et al.
5,377,960 A 1/1995 Leczo et al.
5,788,921 A 8/1998 Gitman et al.
5,865,876 A * 2/1999 Watkins et al. ..... 75/548
6,322,610 B1 11/2001 Pavlicevic et al.
6,558,614 B1 5/2003 Fritz
6,773,659 B2 8/2004 Dunne et al.
2004/0201142 A1 10/2004 Rumen
2008/0128963 A1 6/2008 Cingle et al.

* cited by examiner

*Primary Examiner* — Jessica L Ward
*Assistant Examiner* — Alexander Polyansky
(74) *Attorney, Agent, or Firm* — Rader, Fishman & Grauer PLLC

(57) ABSTRACT

A post-combustion lance for directing a gas at least partially therethrough. The post-combustion lance includes a body having a primary tip from which a first part of the gas exits, upper and lower portions, and a post-combustion distributor mounted between the upper and lower portions and upstream from the primary tip. The distributor includes a number of ports through which a second part of the gas exits the lance. The lance also includes an upper inner tube positioned at least partially upstream from the distributor and an internal support assembly for supporting the body. The internal support assembly includes an internal tube positioned inside the body and coaxial with the body.

11 Claims, 25 Drawing Sheets

POST-COMBUSTION LANCE WITH INTERNAL SUPPORT

This application claims the benefit of U.S. Provisional Application No. 61/023,275, filed on Jan. 24, 2008, which is hereby incorporated by reference in its entirety.

FIELD OF THE INVENTION

This invention is related to a post-combustion lance with a body including an internal support assembly for supporting the body.

BACKGROUND OF THE INVENTION

Metallurgical processes such as basic oxygen steelmaking often employ large (typically, about 8 inches to about 16 inches in diameter and approximately 65-85 feet long) water-cooled oxygen lances to efficiently remove oxidizable elements from molten metal in a metallurgical converter. These lances, which typically weigh up to approximately 10 tons, are known as post-combustion lances. Typically, in addition to the primary oxygen ports at the tip of the lance, the prior art post-combustion lance includes a ring of small oxygen ports located on the outside of the lance a distance up the lance from the primary oxygen tip. The ring is known as a post-combustion (or "PC") distributor.

Due to heat transfer requirements, and also to protect the PC distributor from the furnace atmosphere and the localized heat generated from the post-combustion reaction, the PC distributor (and often, the piping associated therewith) is made of high thermal conductivity metals such as high purity copper.

Although the post-combustion lance often is used to direct oxygen into a metallurgical converter, various other gases may be directed through the lance, depending on the reactions desired. Any and all reaction gases directed through the lance are generally referred to hereinafter as a "gas" for convenience, it being understood that the gas may be oxygen or any other reaction gas or gases. Typically, the gas is injected through the lance at very high rates. For example, oxygen may be injected into the lance at rates of between 300 cubic meters/min. and 600 cubic meters/min.

Cross-sections of a typical post-combustion lance 10 of the prior art are provided in FIGS. 1A and 1B. (The balance of the drawings disclose the invention herein.)

The lance 10 extends between an upstream end 12, at which the gas is introduced therein, and a downstream end 14, at which a primary tip 16 is positioned. The introduction of the gas at the upstream end is represented by arrow "A" in FIG. 1A. A PC distributor 18 is positioned at a predetermined distance from the tip 16. The typical lance includes a lance body 20 having an upper portion 22 and a lower portion 24. The upper portion 22 typically has slightly larger inner and outer diameters than those of the lower portion 24 respectively. The body 20 includes the PC distributor 18, which is mounted between the upper and lower portions 22, 24, as shown in FIG. 1B. Typically, the upper and lower portions 22, 24 are substantially round in cross-section, i.e., they are generally cylindrical.

As shown in FIGS. 1A and 1B, the prior art post-combustion lance 10 typically (but not necessarily) also includes an upper inner tube 26 with an upstream portion 28, a larger second portion 30, and a connecting portion 32 connecting the first and second portions 28, 30. Also, a lower inner tube 34 is positioned inside the body 20, downstream from the upper inner tube 26. Typically, the upper and lower inner tubes 26, 34 are positioned coaxial with each other and with the body 20. The upper and lower inner tubes 26, 34 are shaped to direct part of the gas to the PC distributor 18, and also to direct a part of the gas toward the lower inner tube 34, from which such portion exits the lance at the tip 16. For example, the first part of the gas typically may be about ten percent of the gas flowing through the lance, with the second part being the balance. The part of the gas exiting the PC distributor is represented by arrows "B" in FIG. 1A, and the part of the gas exiting the tip 16 is represented by arrow "C" in FIG. 1A.

As is well known in the art, the upper and lower portions 22, 24 typically include cavities 25 through which water (not shown) is circulated while the post-combustion lance 10 is in use, to cool the lance body 20. Typically, the water is introduced at the upstream end 12 into an intake cavity which extends to the downstream end 14 and the primary tip 16, and the water returns to the upstream end 14 via an output cavity. As is also well known in the art, both the upper inner tube 26 and the lower inner tube 34 are secured to the body. The upper and lower portions 22, 24 are substantially cylindrical, and positioned substantially coaxial with each other. For instance, the axes defined by the upper and lower portions 22, 24 are identified by reference numeral 27 in FIG. 1B. In addition, the upper inner tube 26 typically is positioned substantially coaxial with the upper and lower portions 22, 24. Also, in the prior art lances in which the lower inner tube 34 is included, the lower inner tube 34 (which typically is substantially cylindrical) typically is positioned substantially coaxial with the upper and lower portions 22, 24 and with the upper inner tube 26. It will be understood that various prior art lances are known.

The lance is subjected to bending stresses during its service life, particularly during loading and unloading operations and during lance deskulling operations, where steel and slag buildup on the lance exterior surfaces 36 is removed using aggressive mechanical means, including, e.g., machinery employing hydraulic and/or pneumatic hammers and steel tips. When in use, the lance typically is supported only at the upper portion (i.e., above the distributor). Accordingly, the prior art lance typically is subject to deflection (i.e., substantially or at least partially transverse deflection) due to the bending stresses to which it is subjected. For example, the prior art lance 10 in FIG. 1B may be urged to deflect transversely (i.e., relative to the axes 27) by downward deflection of the lower portion relative to the upper portion, as indicated by arrow "D" in FIG. 1B.

Lances equipped with the PC distributor typically are prone to severe bending (i.e., deflection) and, in some cases, failure at the PC distributor, because of the relatively low yield strength of the high thermal conductivity components in the PC distributor. Since the introduction of the mid-lance PC distributor (i.e., at least in the 1980s, and possibly earlier), no effective solutions to the bending and/or failure problems have been implemented. Prior art post-combustion lances typically bend after a relatively short period in service, requiring relatively frequent replacement of the PC distributor.

Previous attempts to address this problem included the development of external removable protective sleeves which are put on new and refurbished PC distributor equipped lances to protect the lances during shipping to the user's facilities. However, the protective sleeves must be removed before the lance is put into service. In practice, sleeves are typically removed prior to completion of the unloading and installation of the lance. As a result, the lance is often bent subsequent to the protective sleeve removal, i.e., during the completion of installation, while in service, or while the lance is loaded back onto the truck for return repair at the end of its service life.

SUMMARY OF THE INVENTION

For the foregoing reasons, there is a need for an internal support assembly for a post-combustion lance, and a post-combustion lance including same.

In its broad aspect, the invention provides a post-combustion lance for directing a gas at least partially therethrough. The post-combustion lance includes a body extending between an upstream end and a downstream end of the lance, the upstream end being adapted to receive the gas, and the downstream end comprising a primary tip through which a first part of the gas exits the lance. The body includes upper and lower portions and a post-combustion distributor mounted therebetween at a predetermined distance from the primary tip. The distributor includes a number of ports through which a second part of the gas exits the lance. The lance also includes an upper inner tube positioned at least partially upstream from the distributor attached to the upper portion, and a lower inner tube positioned at least partially downstream from the distributor attached to the lower portion. In addition, the lance includes an internal support assembly for supporting the body. The internal support assembly includes an internal tube positioned inside the body and at least partially upstream relative to the lower inner tube. The internal tube is engaged with the lower inner tube. Also, the assembly includes one or more collars positioned between the upper inner tube and the internal tube, to support the internal tube in a predetermined position coaxial with the body so that the internal tube resists deflection of the body.

In another of its aspects, the invention provides an internal support assembly for supporting a body of a post-combustion lance. The internal support assembly includes an internal tube positionable inside the body and at least partially upstream relative to the lower inner tube. The internal tube is engageable with the lower inner tube. Also, the internal support assembly includes one or more collars securable to the internal tube and positionable between the upper inner tube and the internal tube, to maintain the internal tube in a predetermined position coaxial with the body so that the internal tube resists deflection of the body.

The invention also provides a method of mounting an internal support assembly in a body of a post-combustion lance. The method includes, first, cutting the body at a predetermined location thereon upstream relative to a post-combustion distributor to define upper and lower cut portions of the body. Next, the lower cut portion of the body is removed. In the next step, an upper part of the internal support assembly is inserted into the upper cut portion so that one or more collars on an internal tube of the internal support assembly is engageable with the upper inner tube. Next, a collar is attached to the upper inner tube. Subsequently, the lower cut portion of the body is positioned onto a downstream segment of the internal tube. Finally, the lower cut portion is connected to the upper cut portion of the body.

BRIEF DESCRIPTION OF THE DRAWINGS

The invention will be better understood with reference to the attached drawings, in which.

DETAILED DESCRIPTION

Figure 1A:
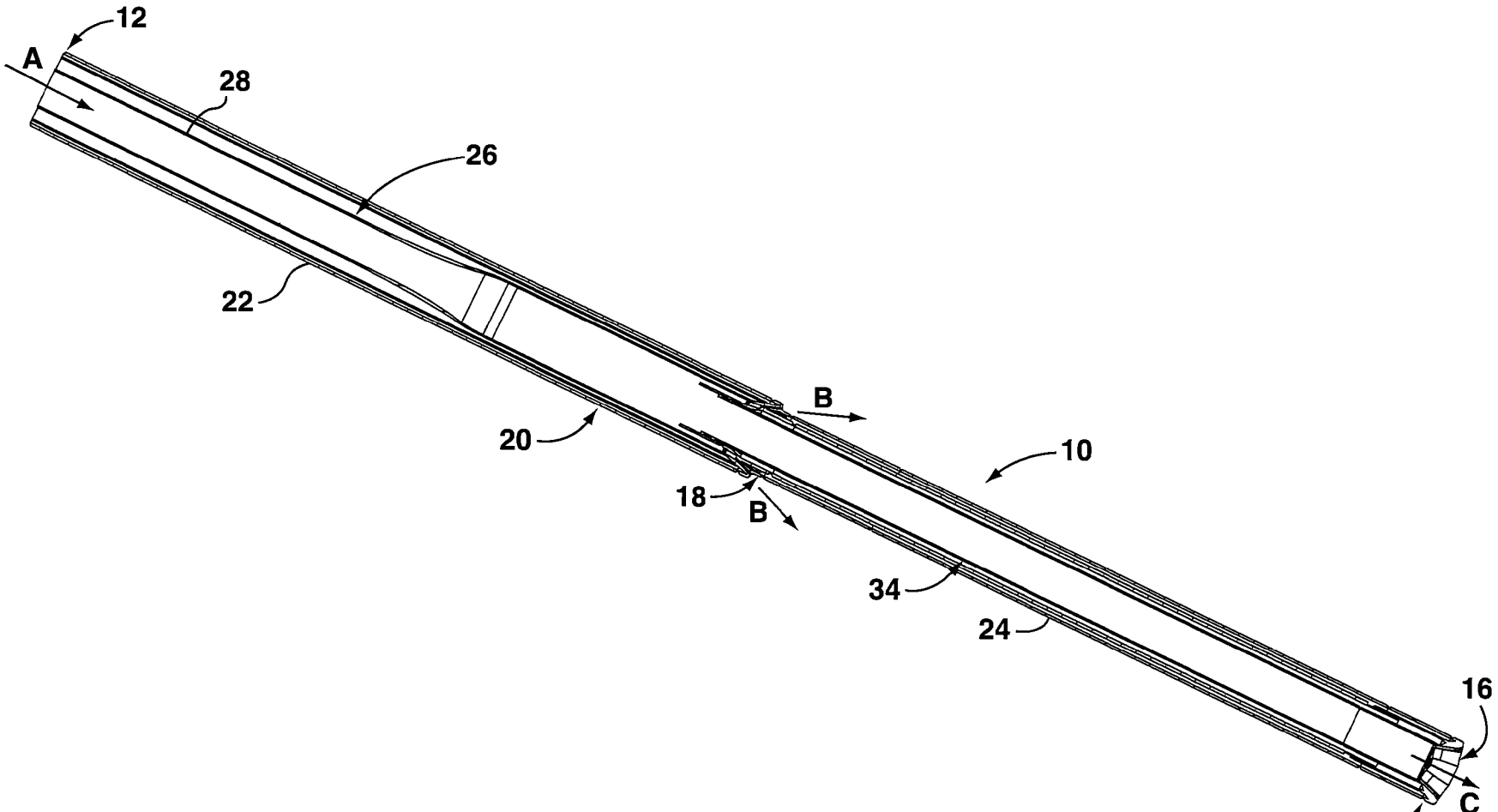
FIG. 1A (Prior Art)
FIG. 1A (also described previously) is a cross-section of a post-combustion lance of the prior art.
Figure 1B:
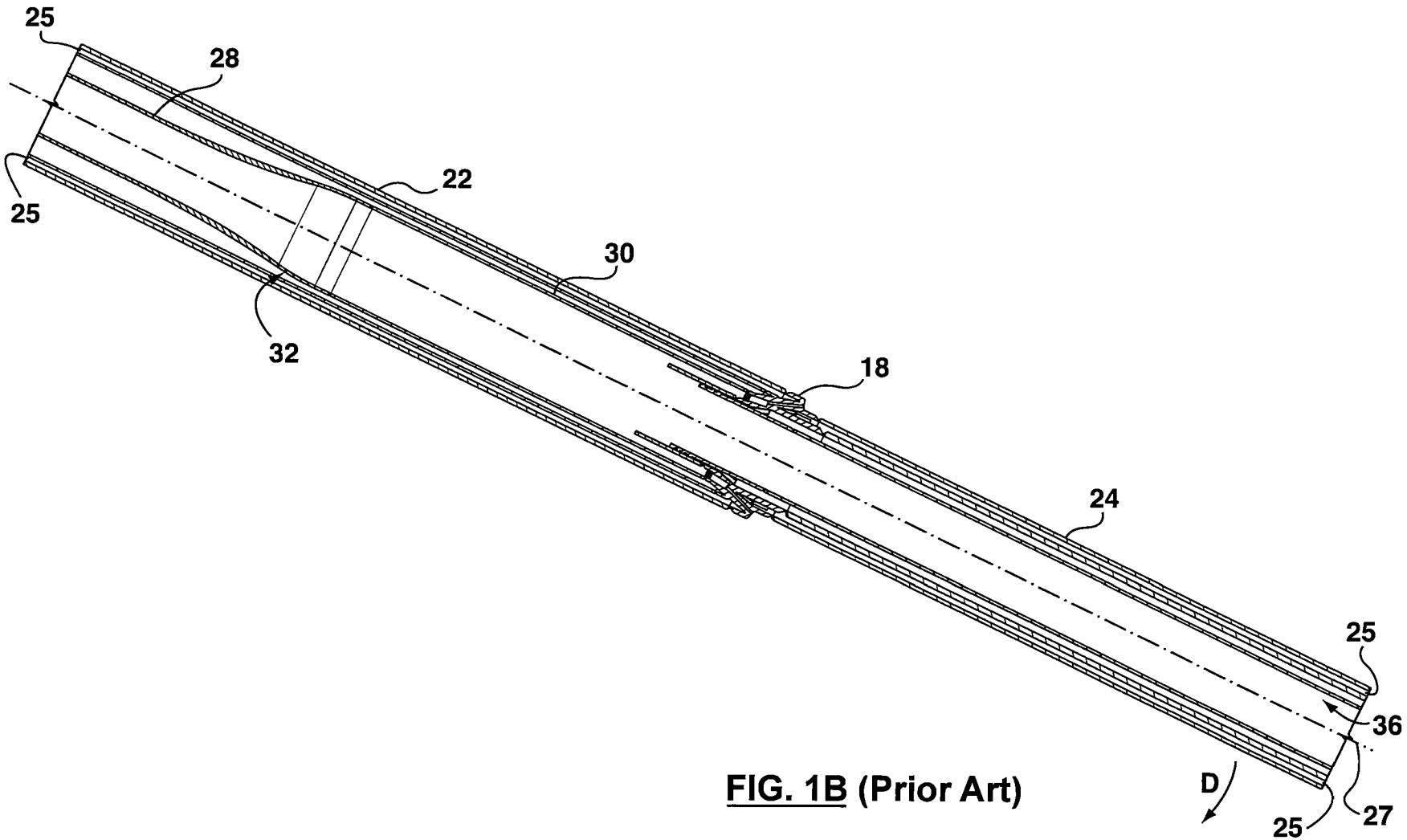
FIG. 1B (Prior Art)
FIG. 1B (also described previously) is a cross-section of a portion of the prior art post-combustion lance of FIG. 1A, drawn at a larger scale.

To simplify the description, the reference numerals used previously in FIGS. 1A and 1B will be used again in connection with the description of the invention hereinafter, except that each such reference numeral is raised by 100 (or by whole number multiples thereof, as the case may be), where the parts described correspond to parts described above.

Reference is first made to FIGS. 2A-2E and 6A-6C to describe an embodiment of a post-combustion lance in accordance with the invention indicated generally by the numeral 140. The post-combustion lance 140 is for directing a gas (not shown) at least partially therethrough. In one embodiment, the post-combustion lance 140 includes a body 120 extending between an upstream end 112 and a downstream end 114 of the lance 140. The upstream end 112 is adapted to receive the gas, and the downstream end 114 includes a primary tip 116 through which a first part of the gas exits the lance 140. The body 120 also includes upper and lower portions 122, 124 and a post-combustion distributor 118 mounted therebetween at a predetermined distance from the primary tip 116. The distributor 118 includes a plurality of ports 119 through which a second part of the gas exits the lance 140. In one embodiment, the lance 140 preferably includes an upper inner tube 126 positioned at least partially upstream from the distributor 118 and attached to the upper portion 122, and a lower inner tube 134 positioned at least partially downstream from the distributor 118 and attached to the lower portion 124. Preferably, the lance 140 also includes an internal support assembly 142 for supporting the body 120, as will be described. In one embodiment, the internal support assembly 142 preferably includes an internal tube 144 positioned inside the body 120 and also positioned at least partially upstream relative to the lower inner tube 134. The internal tube 144 preferably is engaged with the lower inner tube 144, as will also be described. The internal support assembly 142 also includes one or more collars 146 positioned between the upper inner tube 126 and the internal tube 144 to support the internal tube 144 in a predetermined position coaxial with the body 120 so that the internal tube 144 resists deflection of the body 120.

Figure 6A:
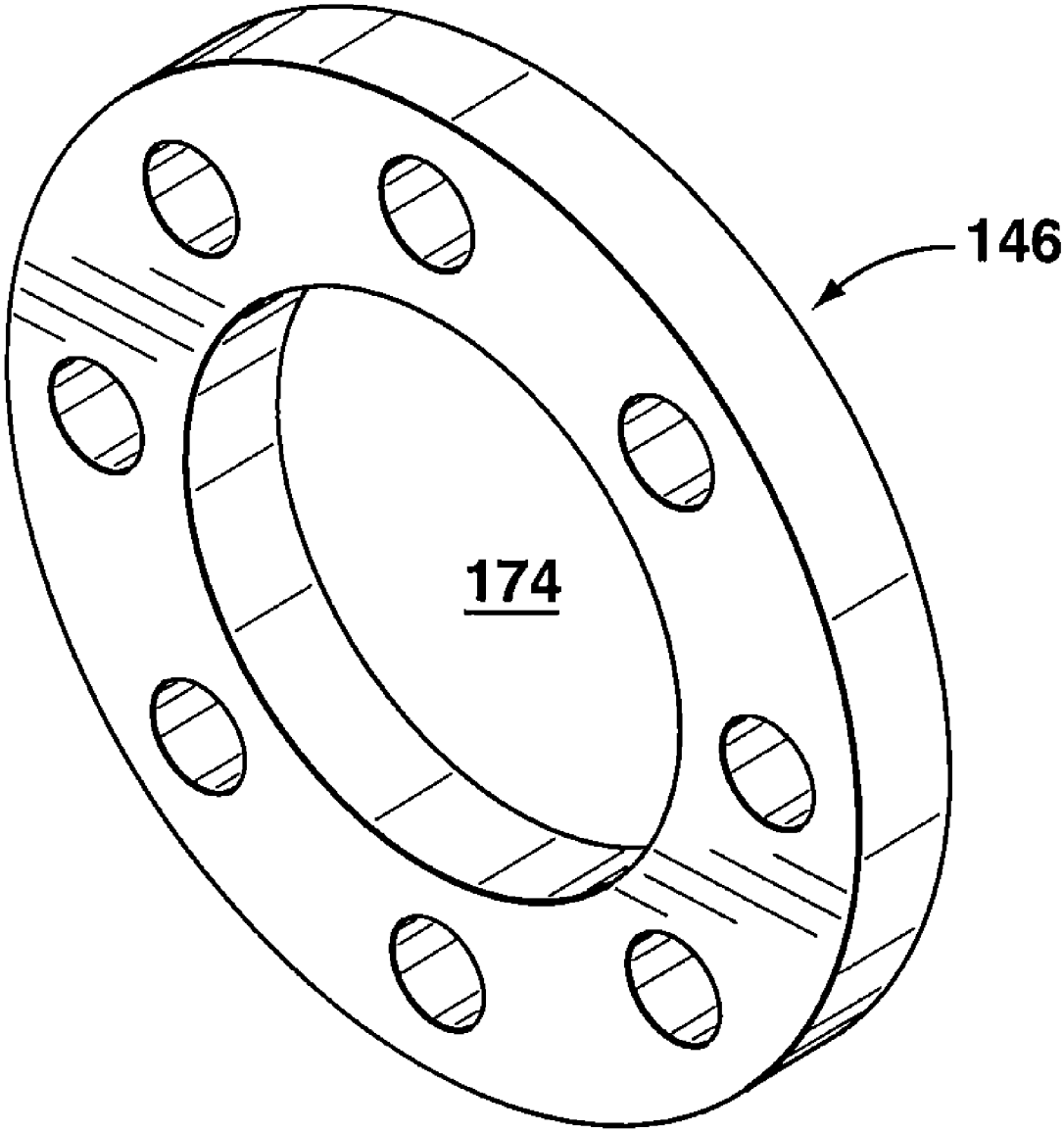
FIG. 6A is an isometric view of an embodiment of a collar of the invention, drawn at a larger scale.
Figure 6C:
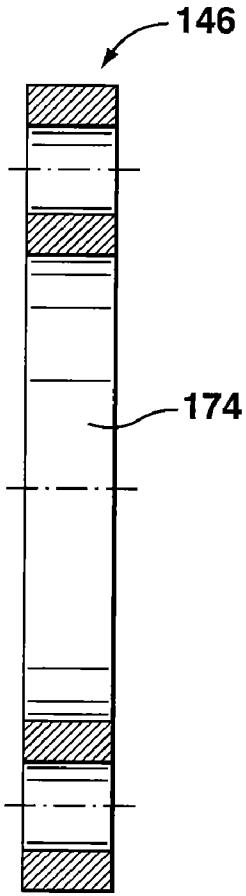
FIG. 6C is a cross-section of the collar of FIGS. 6A and 6B taken along line A-A in FIG. 6B.
Figure 6B:
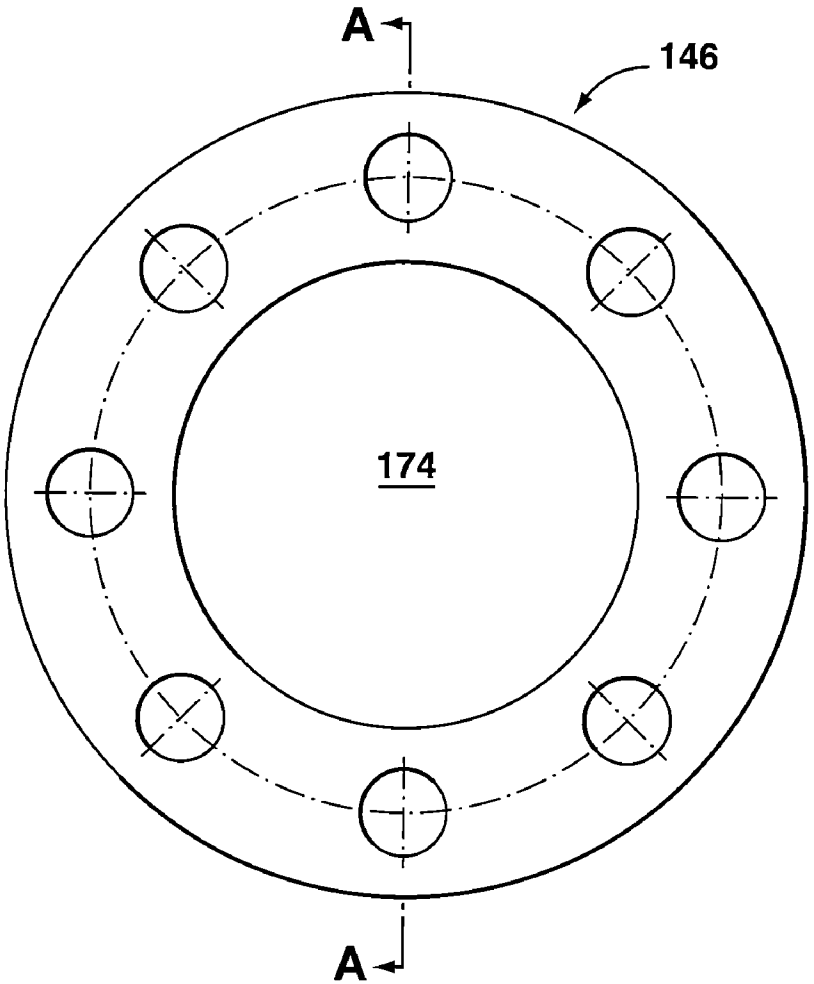
FIG. 6B is a front view of the collar of FIG. 6A, drawn at a larger scale.

An embodiment of the collar 146 of the invention is shown in FIGS. 6A-6C. Preferably, each collar 146 is secured to the internal tube 144. For example, the collar 146 is welded to the internal tube 144, in one embodiment. Also, it is preferred that the collar 146 (i.e., at least one collar 146) is attached to the upper inner tube 126.

Figure 2A:
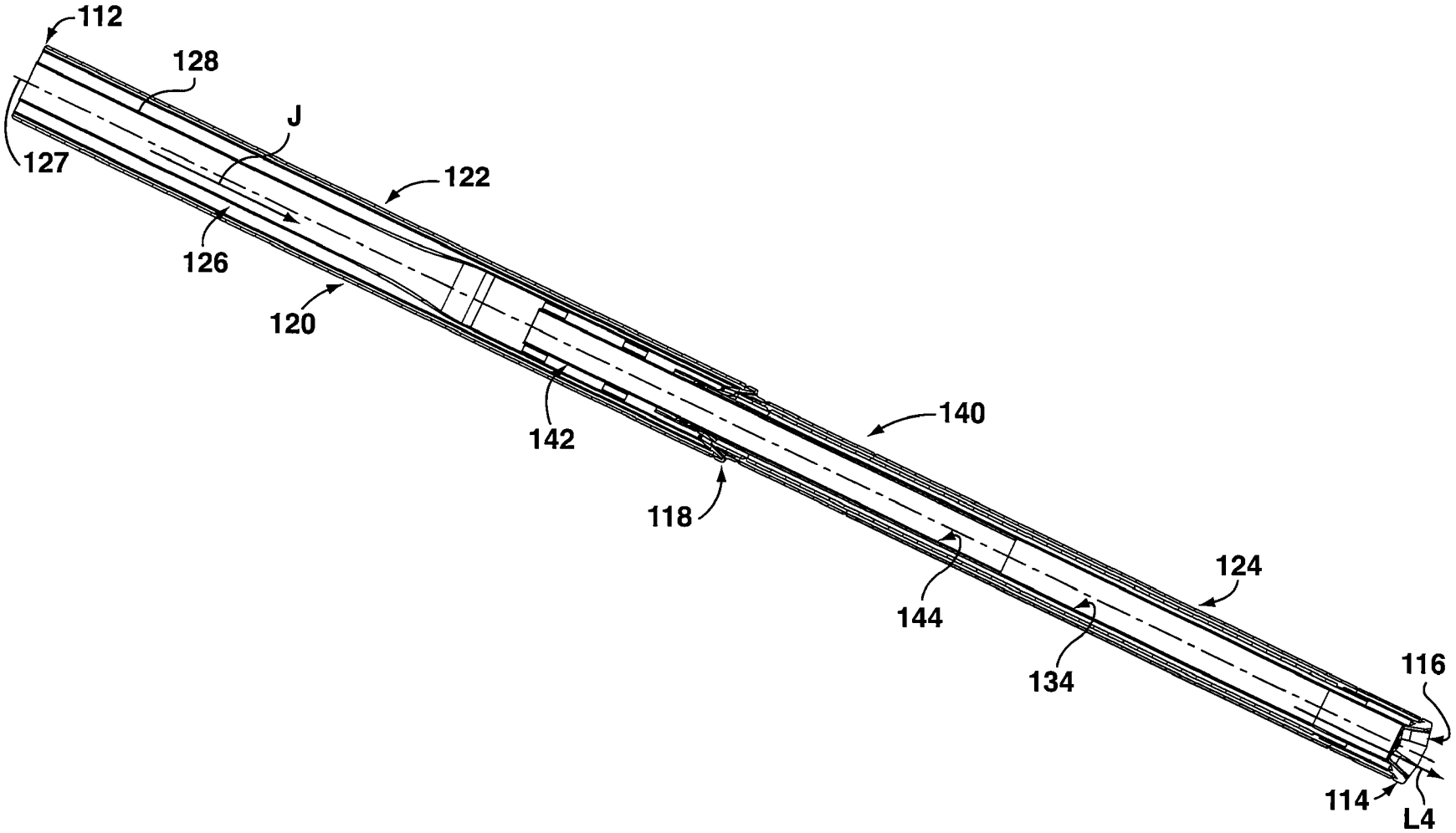
FIG. 2A is a cross-section of an embodiment of a post-combustion lance of the invention including an embodiment of an internal support assembly of the invention, drawn at a smaller scale.
Figure 2B:
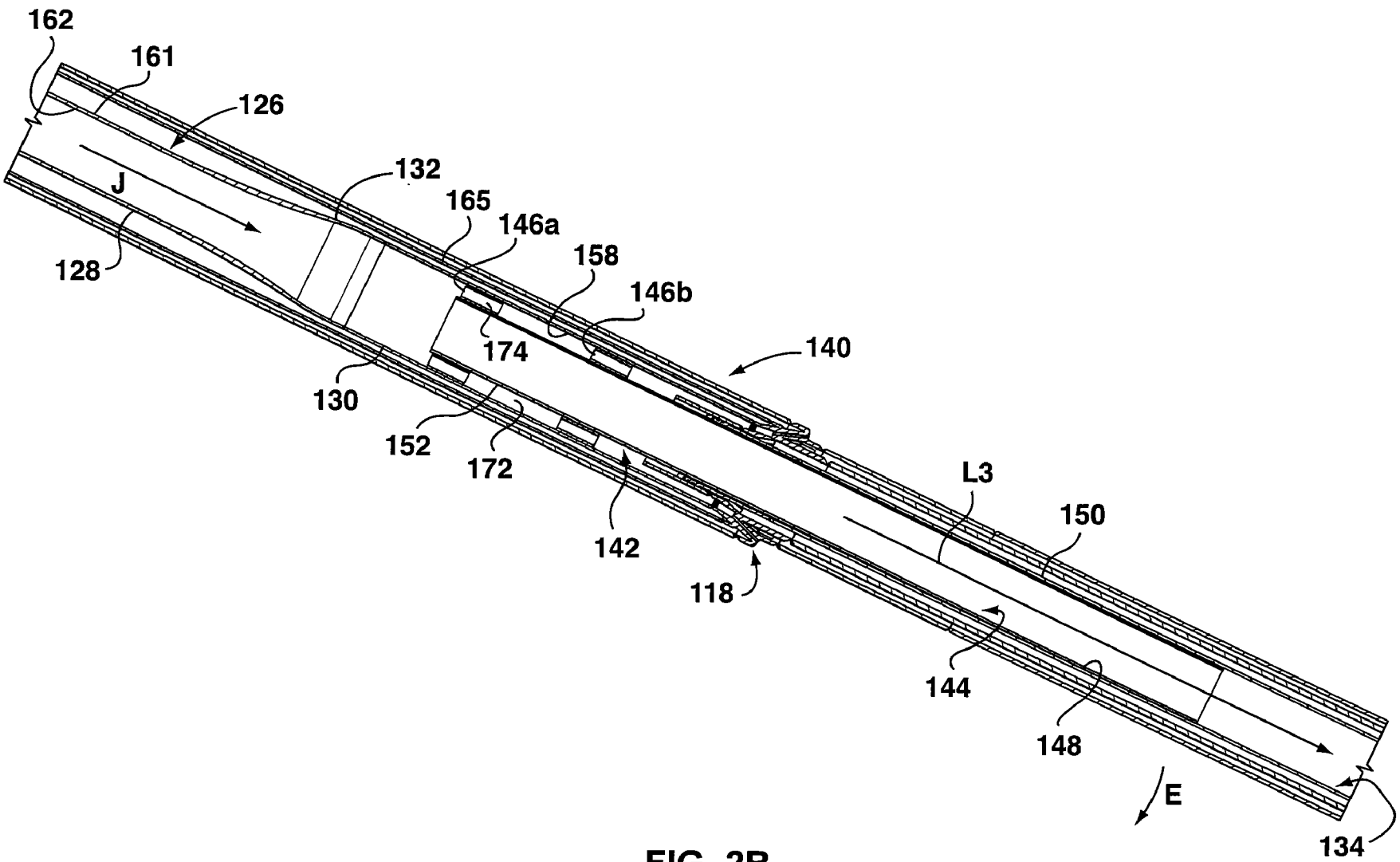
FIG. 2B is a cross-section of a portion of the lance of FIG. 2A, drawn at a larger scale.
Figure 2C:
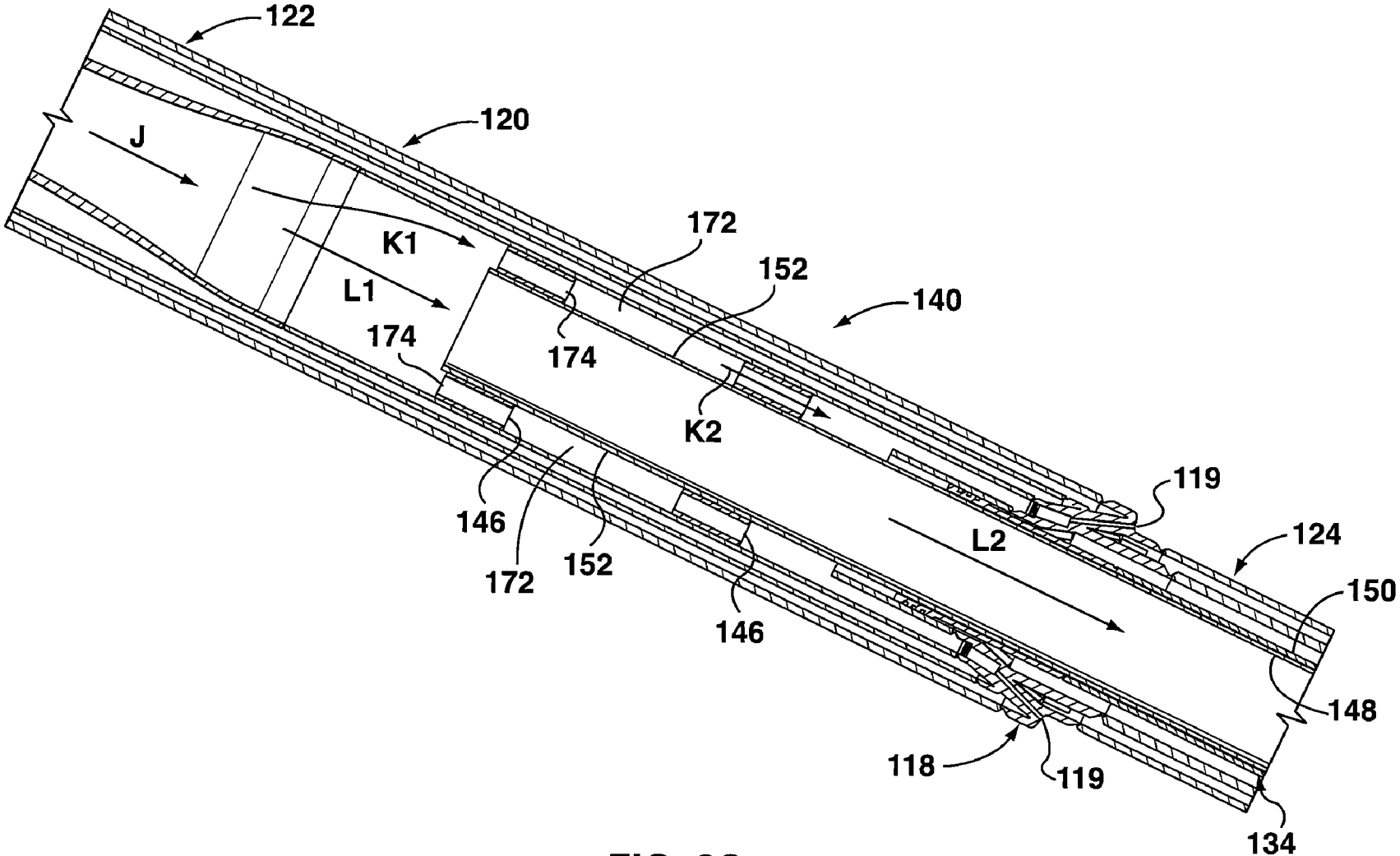
FIG. 2C is a cross-section of a portion of the post-combustion lance of FIG. 2B, drawn at a larger scale.

As can be seen in FIGS. 2B and 2C, a downstream portion 148 of the internal tube 144 engages an upstream portion 150 of the lower inner tube 134. This enables the internal tube 144 to resist deflection of the body 120, and in particular, to resist transverse deflection of the body 120.

The upper inner tube 126 is securely mounted to the upper portion 122. Also, the lower inner tube 134 is securely mounted to the lower portion 124. The manner in which the upper and lower inner tubes 126, 134 are secured to the upper and lower portions 122, 124 is well known in the art, and therefore does not need to be described. As shown in FIGS. 2A-2C, and as will be described, the internal support assembly 142 is connected with each of the upper and lower inner tubes 126, 134 respectively, and thereby also indirectly connected with the upper and lower portions 122, 124.

Figure 2D:
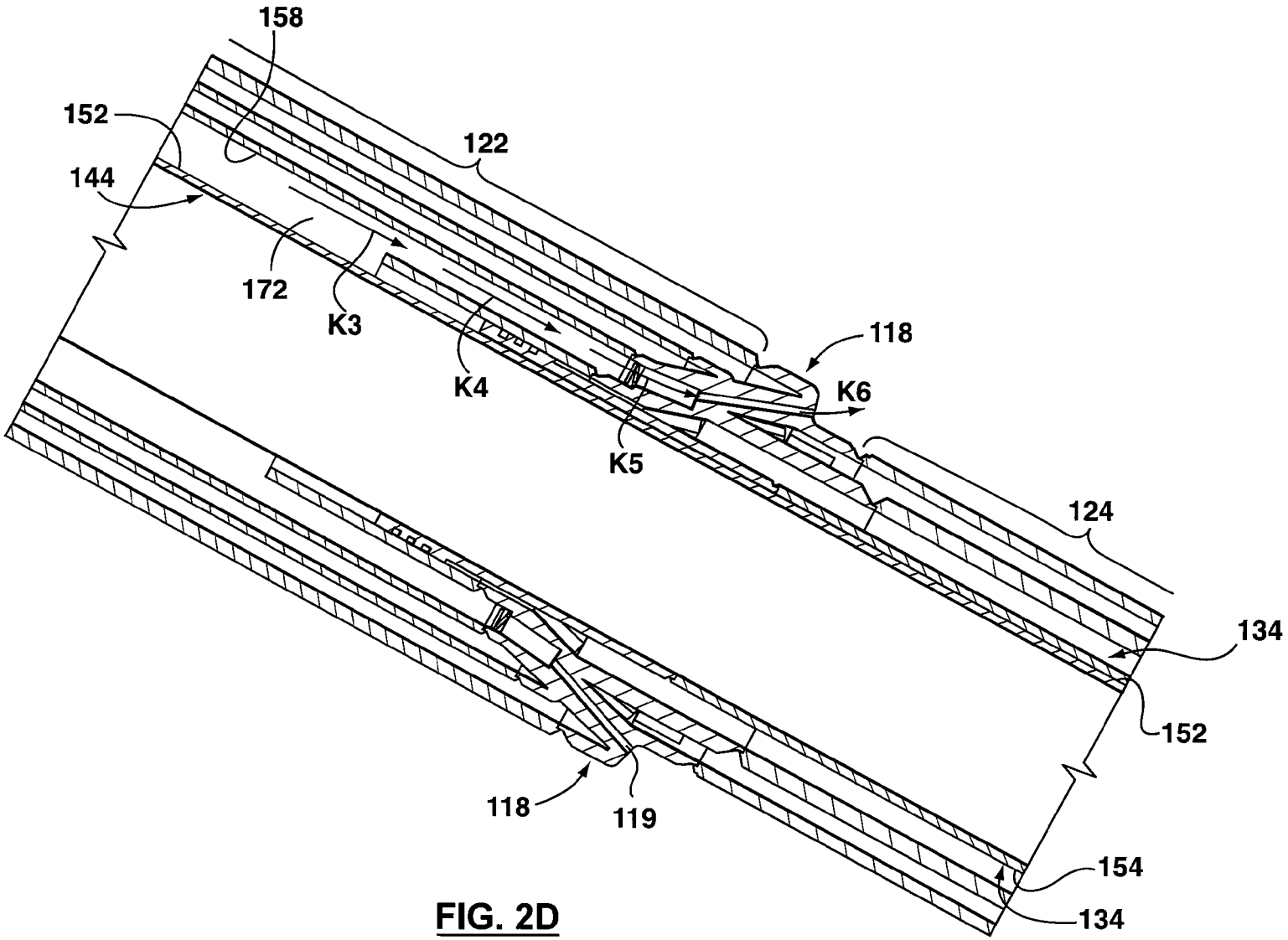
FIG. 2D is a cross-section of a portion of the post-combustion lance of FIG. 2C, drawn at a larger scale.

In one embodiment, an outer wall 152 of the internal tube 144 in the downstream portion 148 thereof engages an inner wall 154 of the lower inner tube 134 in the upstream portion 150 thereof so that the internal tube 144 supports the body 120 (FIG. 2D). Preferably, the downstream portion 148 of the internal tube 144 and the upstream portion 150 of the lower inner tube 134 are slidingly engaged with each other, i.e., longitudinal sliding movement of the internal tube 144 relative to the lower inner tube 134 (and vice versa) is permitted. However, bending (i.e., deflection) of the lower inner tube in an at least partially transverse direction is resisted by the internal tube 144, due to the close engagement of the internal tube 144 and the lower inner tube 134.

As can be seen in FIGS. 2A-2C, the lance 140 preferably includes a plurality of collars 146*a*, 146*b* in which each collar is secured to the outer wall 152 of the internal tube 144. It is preferred that the collars 146 are attached or secured to an upstream portion 156 of the internal tube 144, i.e., a portion of the internal tube upstream relative to the ports 119. Preferably, one of the collars (in the drawings, the collar 146*b*) is also attached to an inner wall 158 of the upper inner tube 126, to position the internal tube 144 substantially coaxially with the body 120. The axes 127 of the upper and lower portions are shown in FIG. 2A. For example, it is preferred that each collar 146*a*, 146*b* is welded to the outer wall 152 of the internal tube 144. As will be described, in one embodiment, only one of the collars (e.g., the collar 146*b*, as shown in FIG. 2C) preferably is attached to the inner wall 158 of the upper inner tube 126 (FIGS. 2B, 2C). As can be seen in FIGS. 2B and 2C, where the collar 146*b* is attached (e.g., by welding) to the inner wall 158, the other collar 146*a* preferably engages the inner wall 158.

Accordingly, and as noted above, it can be seen that the upstream portion 156 of the internal tube 144 is indirectly connected (i.e., via the engagement and/or attachment of the collars to the upper inner tube) with the upper portion 122 of the body 120, and the downstream portion 148 of the internal tube 144 is indirectly connected (i.e., via the engagement of the downstream portion of the internal tube with the upstream portion of the lower inner tube) with the lower portion 124 of the body 120. Because of the indirect connection of the internal tube's upstream portion 156 and downstream portion 148 with the upper and lower portions 122, 124 respectively, the internal support assembly 142 resists deflection of the body, particularly deflection thereof in an at least partially transverse direction.

As can be seen in FIGS. 2A-2C, the upper inner tube 126 preferably includes an upstream portion 128 proximal to the upstream end 112. The upstream portion 128 preferably is substantially cylindrical, and has outer and inner diameters defined by outer and inner walls 161, 162 (FIG. 2B). The upper inner tube 126 preferably also includes a downstream portion 130 located proximal to the distributor 118. The downstream portion 130 preferably has an outer diameter defined by an outer wall 165 substantially larger than the outer diameter of the upstream portion 128 and an inner diameter defined by the inner wall 158 substantially larger than the inner diameter of the upstream portion 128 (FIG. 2B). In addition, the upper inner tube 126 preferably also includes a connecting portion 132 connecting the upstream and downstream portions 128, 130. The internal tube 144 preferably has an outer diameter defined by the outer wall 152 thereof, which is substantially smaller than the inner diameter of the downstream portion 130. An annulus 172 is defined accordingly between the internal tube 144 and the downstream portion 130 (FIGS. 2B, 2C). Preferably, the annulus 172 is in fluid communication with the ports 119 (FIGS. 2B, 2C, 2C).

In addition, and as can be seen in FIGS. 2C, 6A, 6B, and 6C, each collar 146 preferably includes one or more apertures 174 to permit the second part of the gas to flow therethrough to the ports 119.

As noted above, the upper portion 122 and the lower portion 124 of the lance body 120 preferably are made of steel. The distributor 118 typically includes materials with relatively good heat conductivity, e.g., copper.

Figure 2E:
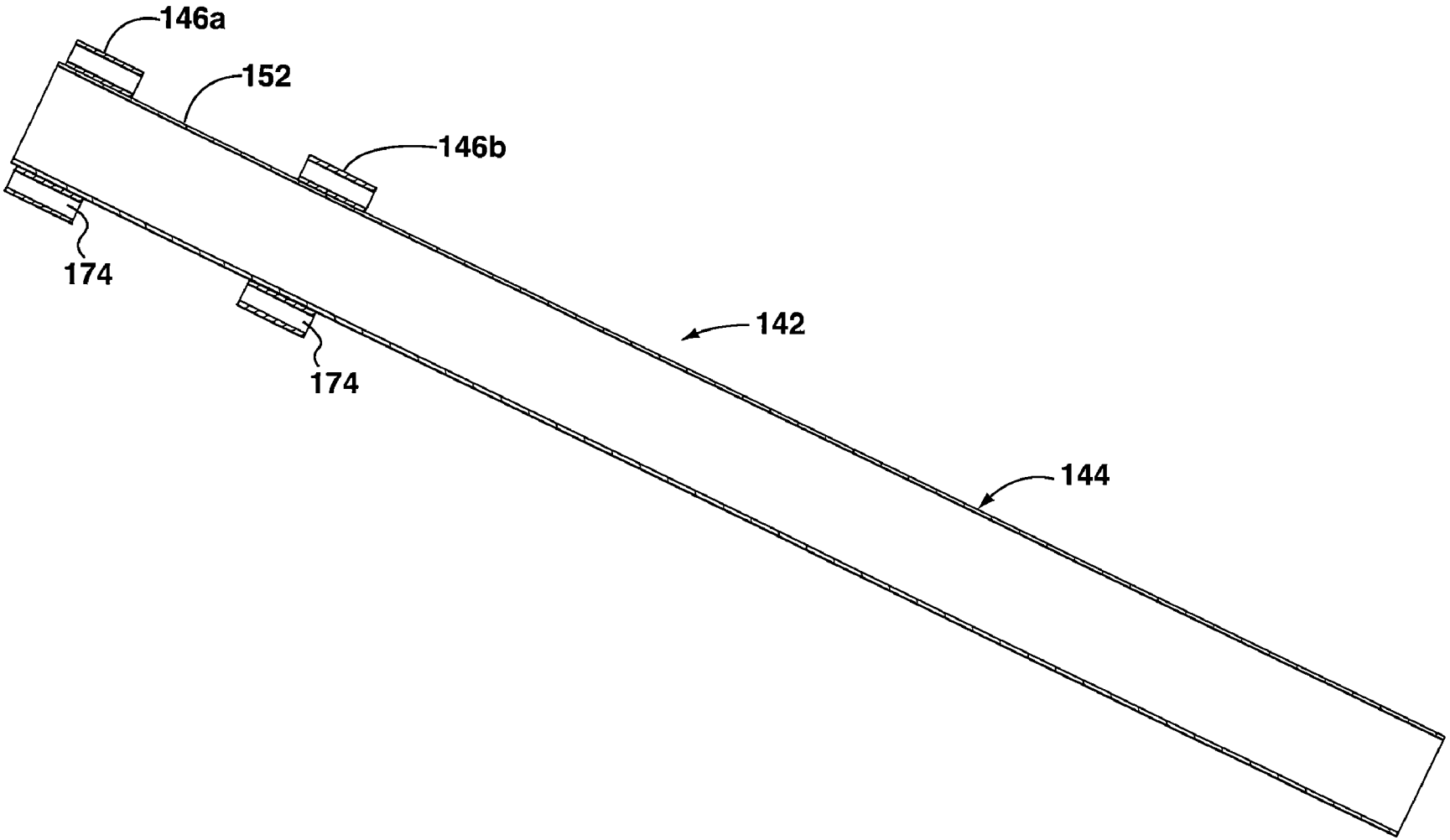
FIG. 2E is a cross-section of an embodiment of an internal support assembly of the invention, drawn at a smaller scale.

The internal support assembly 142 may be made of any suitable materials. For example, the internal tube 144 and the collars 146 may be made of steel. As shown in FIG. 2E, in one embodiment, the support assembly 142 preferably includes the internal tube 144 and two collars 146*a*, 146*b*.

As described above, the internal tube 144 is positionable inside the body 120 and at least partially upstream relative to the lower inner tube 134. Preferably, the internal tube 144 is engageable with the lower inner tube 134. Also, the internal support assembly 142 includes one or more collars 146 which are securable to the internal tube 144 and positionable between the upper inner tube 126 and the internal tube 144, to maintain the internal tube 144 in a predetermined position relative to the upper inner tube 126 and the lower inner tube 134. Preferably, the internal tube 144 is positioned coaxial with the upper and lower inner tubes 126, 134, to facilitate flow of the gas through the lance 140. As well, and as described above, the internal tube 144 is positioned to resist deflection of the body 120.

In use, the lance 140 is supported at or close to the upstream end 112. Because only the upper portion is directly supported while the lance is in operation, gravity urges the lower portion 124 of the lance downwardly, as indicated by arrow "E" in FIG. 2B. The downwardly directed force is substantially transverse (or at least partially transverse) to the body. However, as can be seen in FIG. 2B, the internal tube 144 resists deflection of the lance body because the internal tube 144 is engaged with the lower inner tube at the downstream portion 148 thereof, and the internal tube 144 is also engaged with the upper inner tube 126, i.e., via the collars 146*a*, 146*b*.

The internal support assembly 142 is assembled by securing the collars 146 to the outer wall 152 of the internal tube 144 (FIG. 2E). The internal support assembly 142 is positioned in the body 120 as shown in FIGS. 2A-2C. Preferably, the internal tube 144 is mounted in the body 120 substantially coaxial with the body 120, so that the internal tube 144 resists deflection of the body. The gas as initially introduced into the lance 140 is represented by arrow "J" in FIGS. 2A, 2B, and 2C. Part of the gas (represented by arrows "K1", "K2", "K3", "K4", "K5", and "K6" in FIGS. 2C and 2D) is directed through the apertures 174 in the collars 146*a*, 146*b* and along the annulus 174 to the port 119, where the part of the gas exits the lance 140. The other part of the gas (represented by arrows "L1", "L2", "L3" in FIGS. 2A, 2B, 2C, and 2D) is directed inside the internal tube 144 and through the lower inner tube 134 to the tip 116, where it exits the lance 140.

Additional embodiments of the invention are shown in FIGS. 3A-5C and 7A-8B. In FIGS. 3A-5C and 7A-8B, elements are numbered so as to correspond to like elements shown in FIGS. 2A-2E and 6A-6C.

It will be understood that the internal support assembly 142 of the invention may be retrofitted into an existing post-combustion lance. The steps of the method of retrofitting the internal support assembly 142 in a prior art post-combustion lance are shown in FIGS. 7A-7E.

Figure 7A:
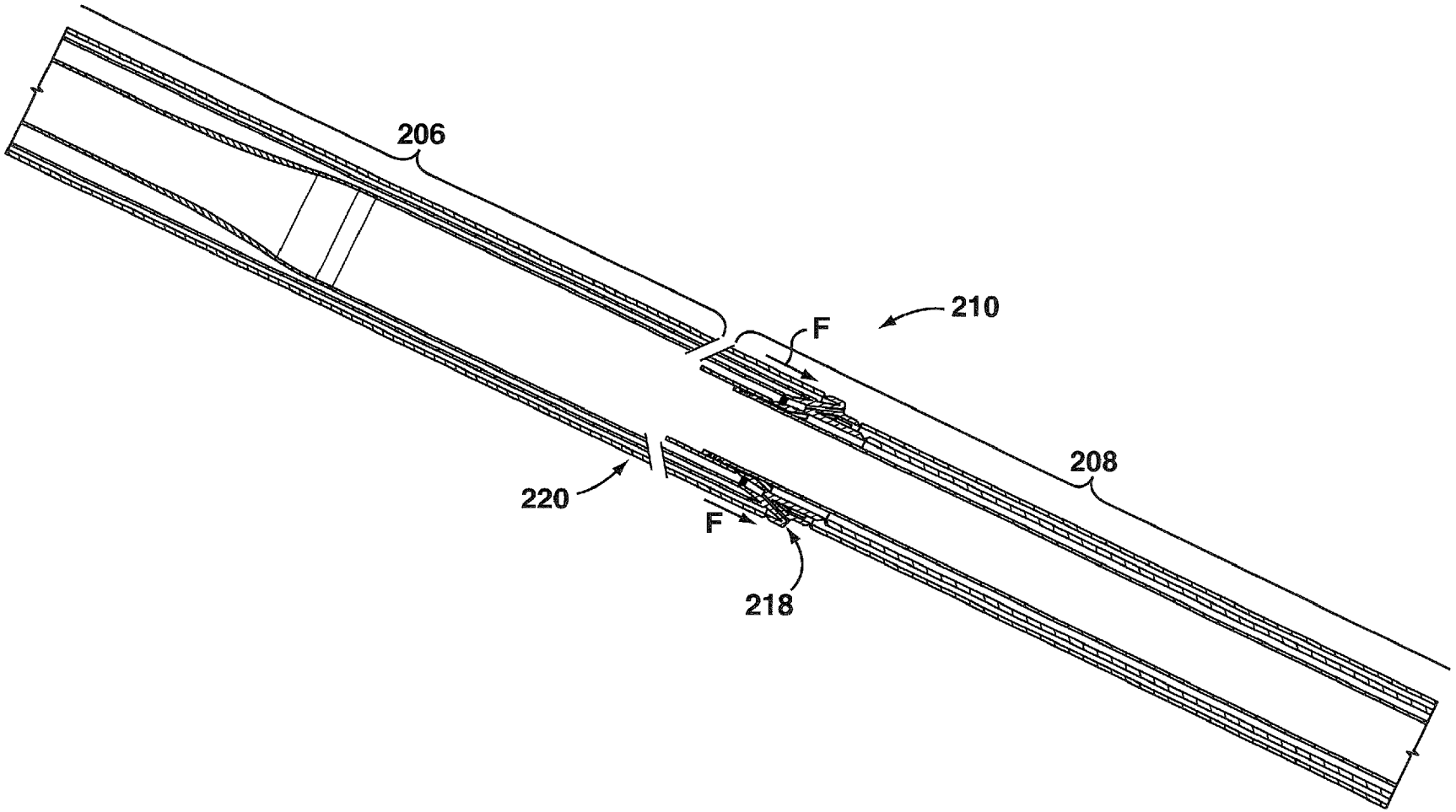
FIG. 7A is a cross-section of a portion of a prior art lance illustrating a first step in an embodiment of a method of the invention.

As shown in FIG. 7A, a prior art lance 210 is cut using any suitable means for doing so at a suitable location on the lance body, the suitable location preferably being upstream relative to the distributor 218. For example, the body may be cut by a cutting torch. The cut defines upper and lower cut portions 206, 208 of the lance body 220.

Figure 7B:
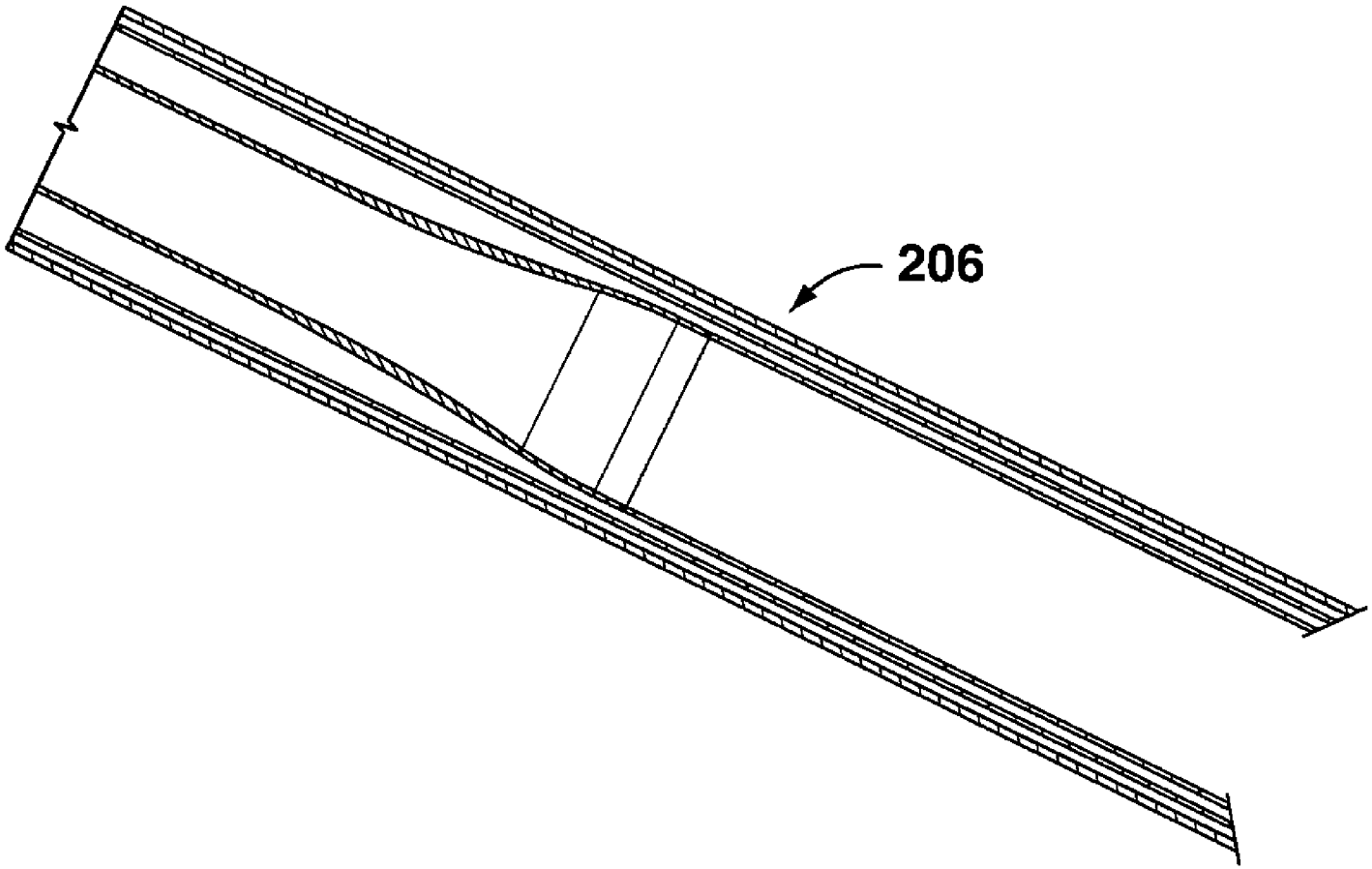
FIG. 7B is an illustration of a second step of the method of FIG. 7A.

Preferably, the lower cut portion 208 is then removed from the upper cut portion 206, as indicated by arrows "F" in FIG. 7A. The upper cut portion 206 is shown in FIG. 7B.

Figure 7C:
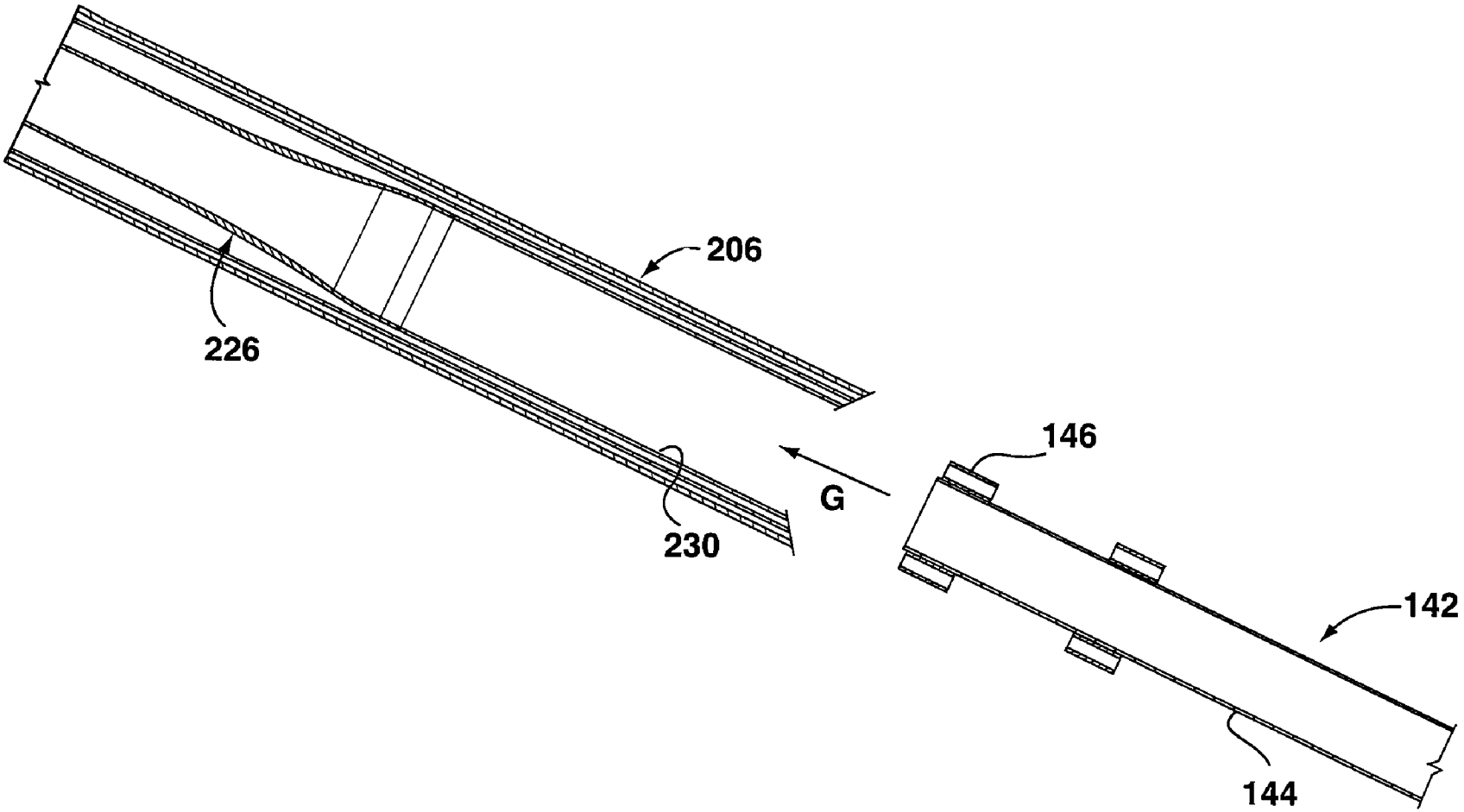
FIG. 7C is an illustration of a third step of the method of FIG. 7A.
Figure 7D:
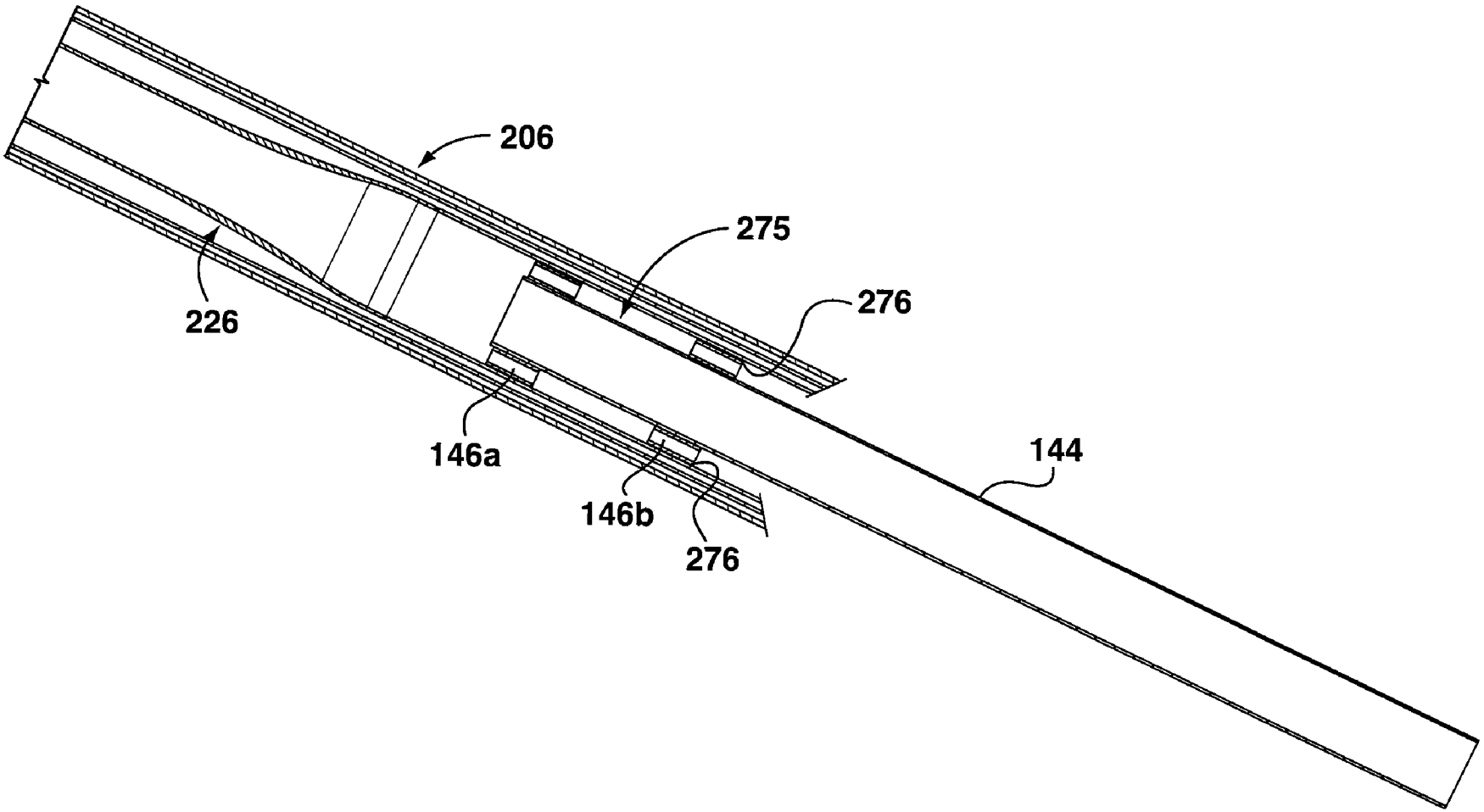
FIG. 7D is an illustration of a fourth step of the method of FIG. 7A.

In FIG. 7C, the next step is shown. In this step, the internal support assembly 142 is moved into the upper cut portion 206, in the direction indicated by arrow "G" in FIG. 7C. The internal support assembly 142 preferably is formed so that the collars 146 are slidingly receivable in the downstream portion 230 of the upper inner tube 226.

Once a predetermined portion 275 of the internal support assembly 142 is positioned in the downstream portion 230 of the upper inner tube 226, one of the collars 146 is attached to the upper inner tube 226. For example, it is preferred that the collar 146*b* is welded to the upper inner tube 226, at the location identified by reference numeral 276 in FIG. 7D.

Figure 7E:
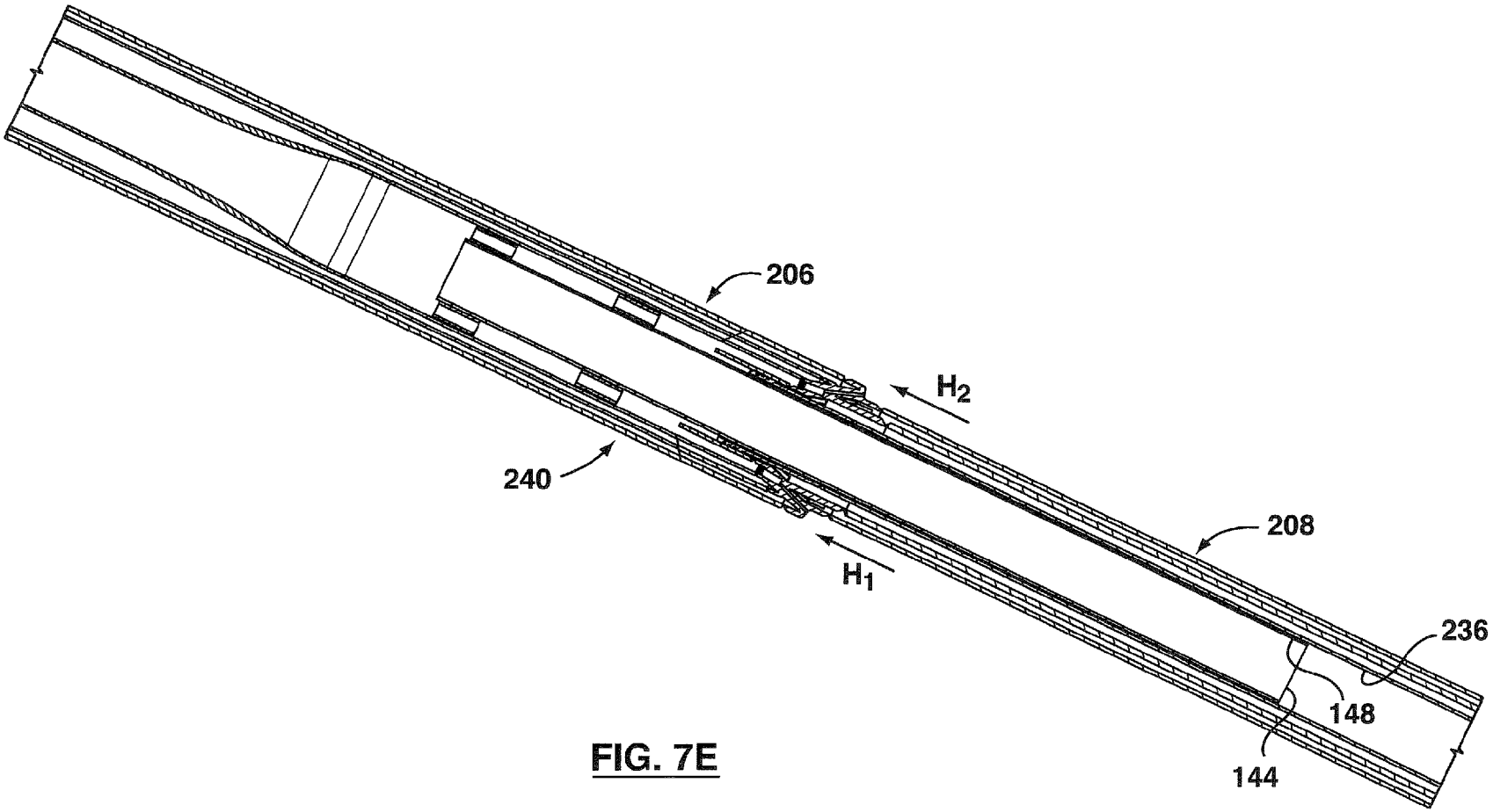
FIG. 7E is an illustration of a fifth step of the method of FIG. 7A.

In FIG. 7E, the lower cut portion 208 (or a replacement thereof, as described below) is slidingly engaged with the internal tube 144 as the lower cut portion 208 is moved in the direction indicated by arrows "H" in FIG. 7E. As can be seen in FIG. 7E, the lower inner tube 236 in the lower cut portion 208 is slidingly engaged with the downstream portion 148 of the internal tube 144 as the lower cut portion 208 is moved in the direction indicated by arrows "H1" and "H2". Once the lower cut portion 208 abuts the upper cut portion 206, the lower cut portion 208 is in position.

Finally, the lower cut portion 208 is attached to the upper cut portion 206 of the lance body 220, using any suitable means. For instance, the lower cut portion 208 may be welded to the upper cut portion 206. The result is a post-combustion lance 240 of the invention, as shown in FIG. 7E.

Those skilled in the art would appreciate that a new lower cut portion (i.e., rather than the lower cut portion which was removed) may be attached to the upper cut portion. Using a new portion may be preferable if, for example, the old portion was deformed.

Figure 3A:
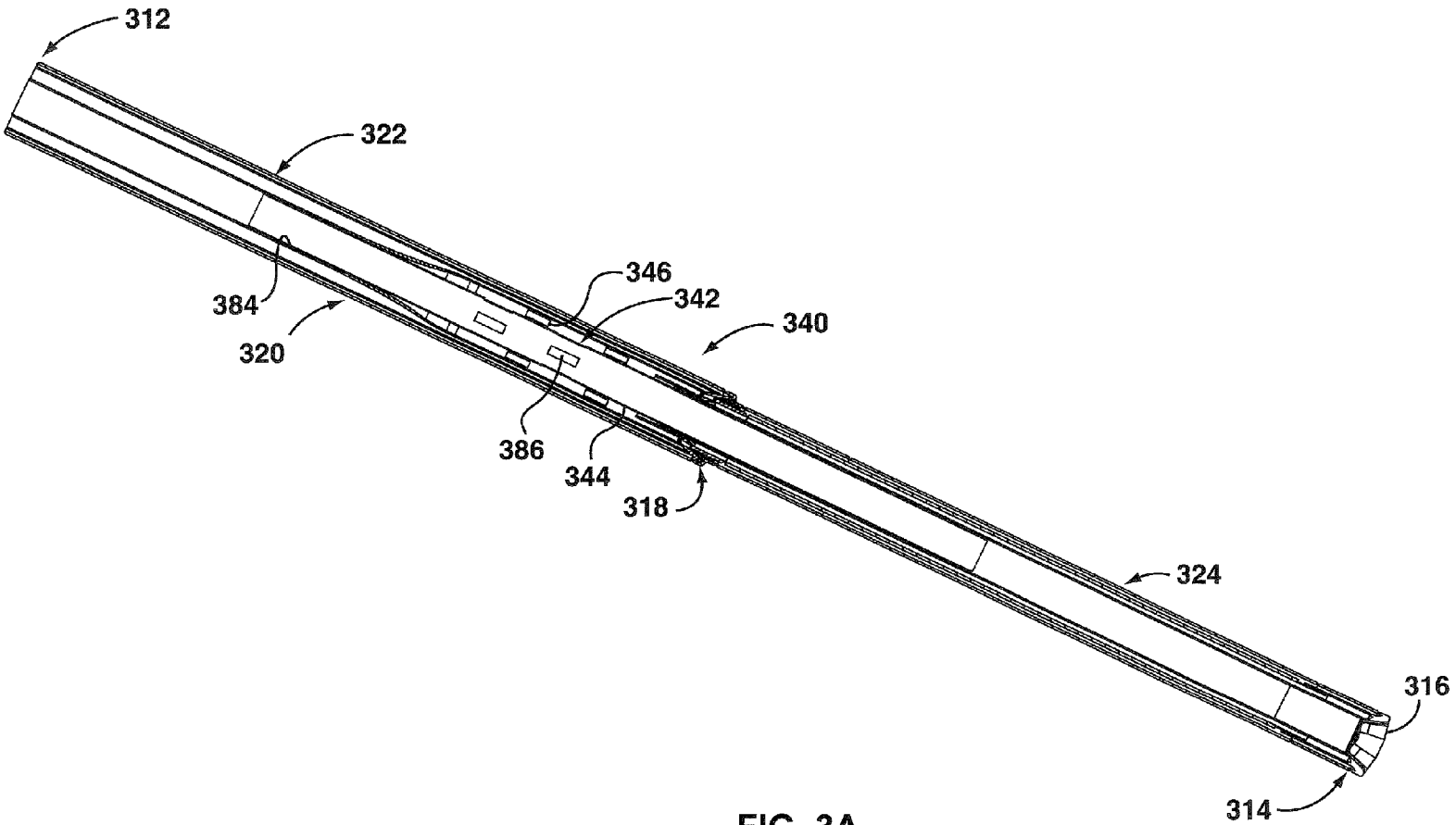
FIG. 3A is a cross-section of another embodiment of the post-combustion lance of the invention, drawn at a smaller scale.
Figure 3B:
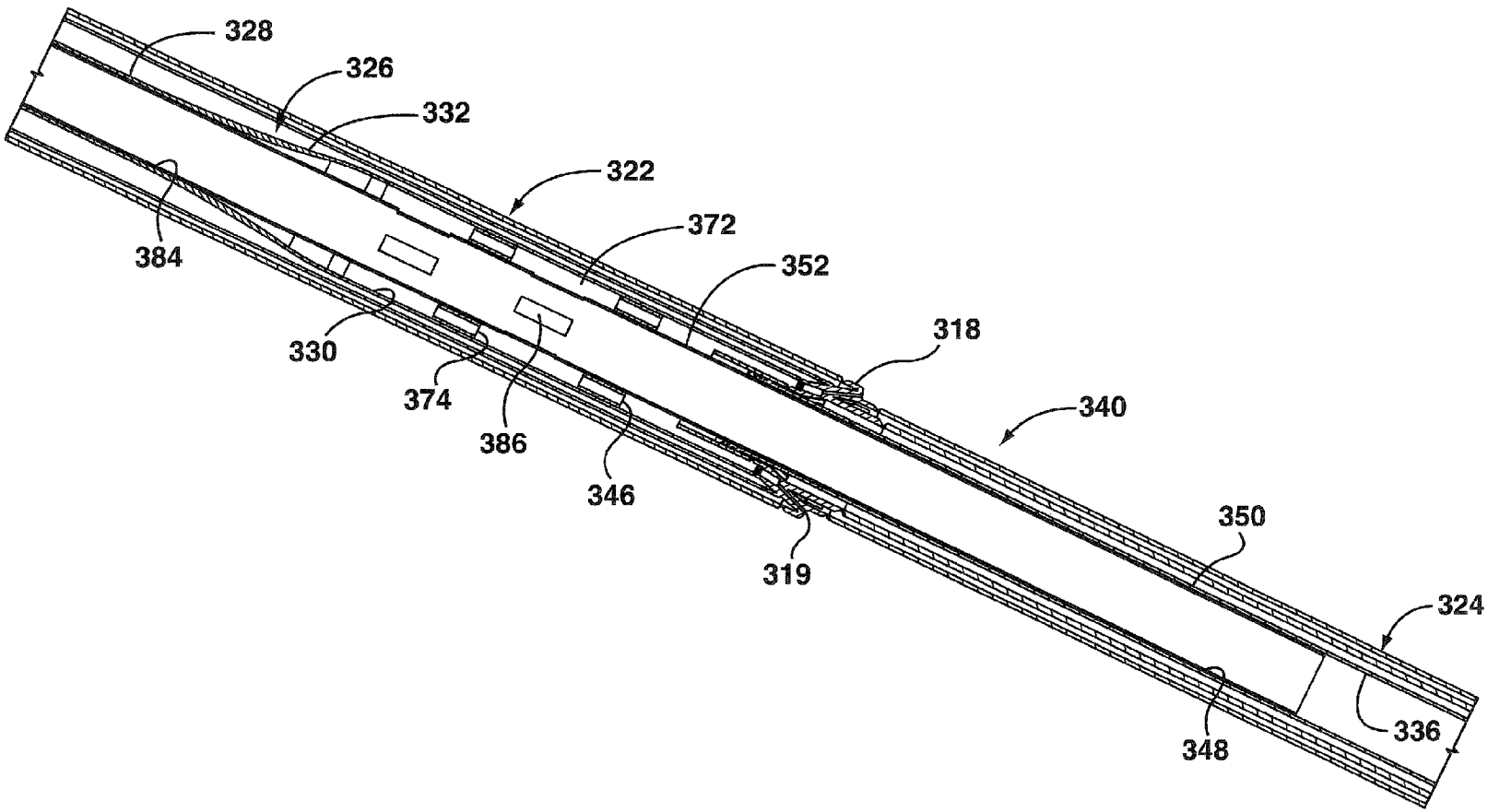
FIG. 3B is a cross-section of a portion of the post-combustion lance of FIG. 3A, drawn at a larger scale.
Figure 3C:
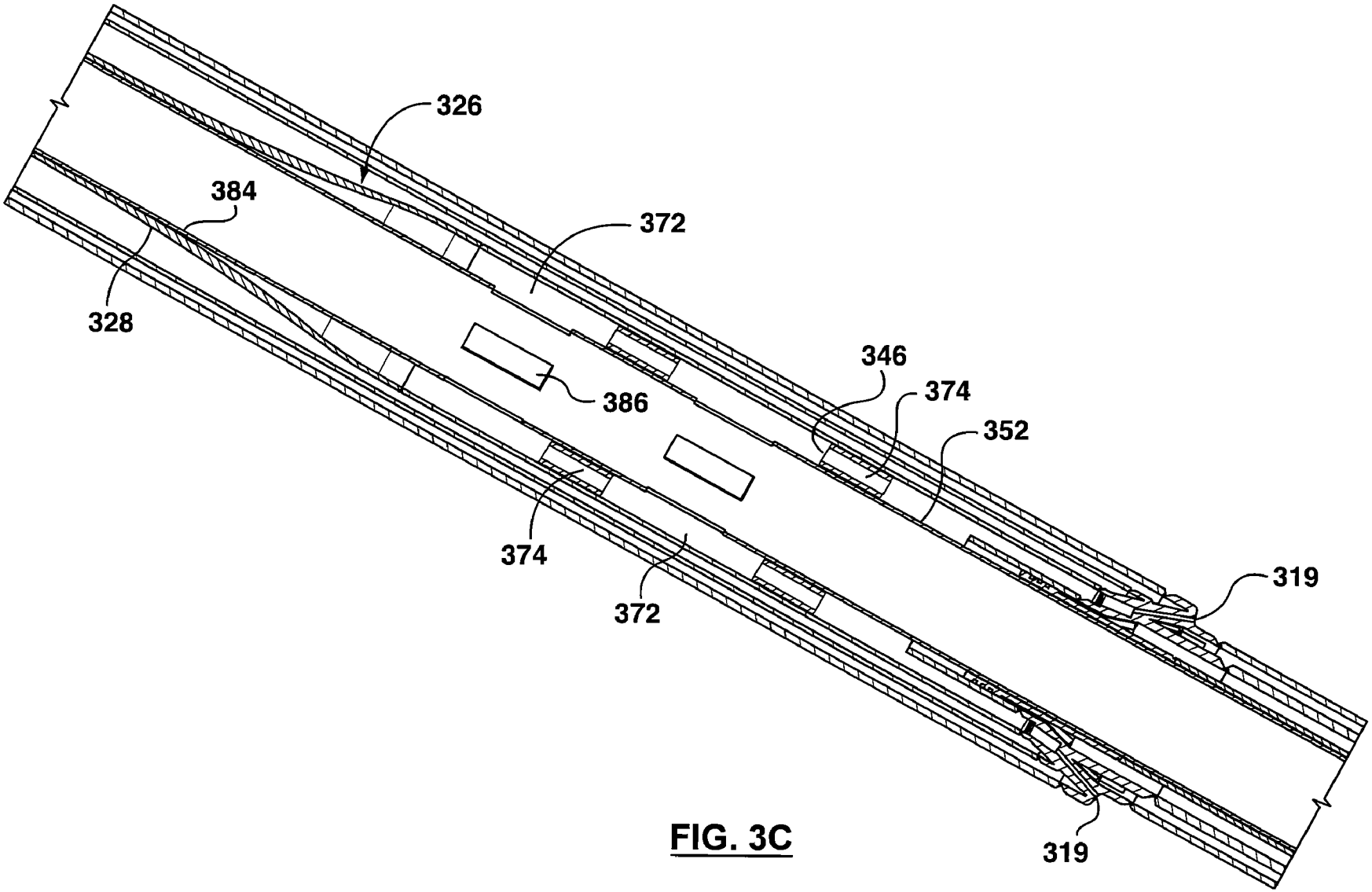
FIG. 3C is a cross-section of a portion of the post-combustion lance of FIG. 3B, drawn at a larger scale.

FIGS. 3A-3C disclose another embodiment of the post-combustion lance 340 of the invention in which an internal support assembly 342 includes an internal tube 344 which preferably has an upstream portion 384 engaged with the upstream portion 328 of the upper inner tube 326. Preferably, the internal tube 344 additionally includes one or more apertures 386 positioned at least partially upstream relative to the distributor 118 to permit the second part of the gas to flow to an annulus 372 from the upstream portion of the upper inner tube 326.

As can be seen in FIG. 3A, the post-combustion lance 340 includes a body 320 extending between an upstream end 312 and a downstream end 314. Gas is receivable at the upstream end, and a first part of the gas exits the lance 340 via a primary tip 316 positioned at the downstream end 314. A distributor 318 mounted between the upstream and downstream ends 312, 314 is positioned between upper and lower portions 322, 324 of the body.

The upstream portion 384 of the internal tube 344 preferably extends further in an upstream direction (i.e., upstream beyond the downstream portion 330 and the connecting portion 332 of the upper inner tube 326) to engage the upstream portion 328 of the upper inner tube 326. The advantage of this embodiment (as compared to the lance 140, described above) is that it provides an additional area of engagement (i.e., as compared to lances 140 and 240) between the internal tube and the upper inner tube. In one embodiment, the collars 346 are positioned between the internal tube 344 and the upper inner tube 326. Because the upper inner tube 326 is secured to the upper portion 322, this means that the internal tube 344 is indirectly connected with the upper portion 322 via the collars 346, and also via the engagement of the upstream portion 384 of the internal tube 344 with the upstream portion 328 of the upper inner tube 326. A downstream portion 348 of the internal tube 344 is also engaged with an upstream portion 350 of the lower inner tube 336. Accordingly, the internal support assembly 342 resists deflection of the body 320.

Preferably, the upstream portion 384 of the internal tube 344 is slidingly engaged with the upstream portion 328, and the downstream portion 348 of the internal tube 344 is slidingly engaged with the upstream portion 350 of the lower inner tube 336.

As shown in FIGS. 3A-3C, because of the engagement of the upstream portion 384 of the internal tube 344 with the upstream portion 328 of the upper inner tube 326, the apertures 386 are provided in the internal tube 344. An annulus 372 is defined between an outer wall 352 of the internal tube 344 and the connecting and downstream portions 332, 330 of the upper inner tube 326. The annulus 372 is in fluid communication with the ports 319 via apertures 374 in the collars 346.

Figure 4A:
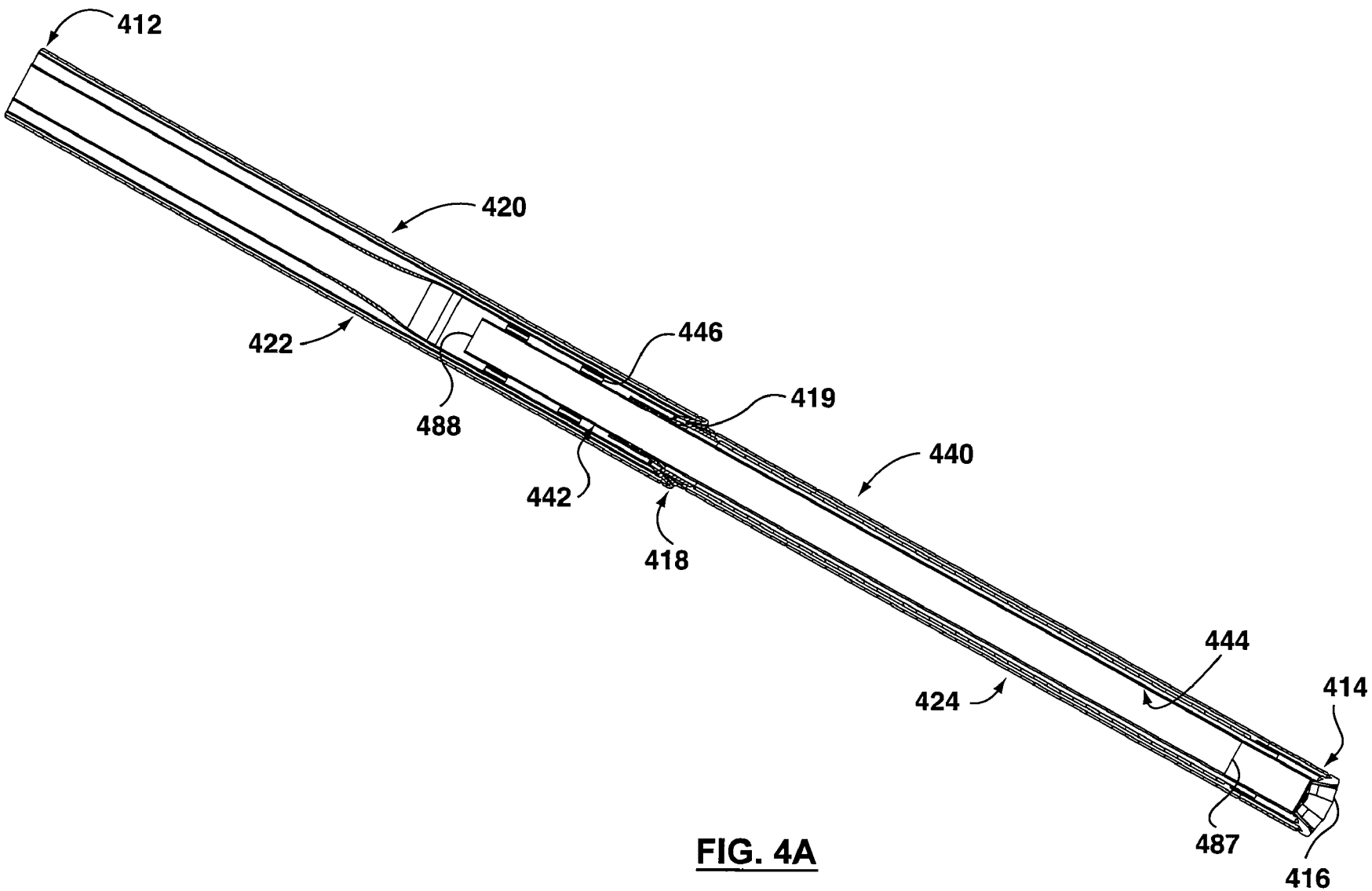
FIG. 4A is a cross-section of another embodiment of the post-combustion lance of the invention, drawn at a smaller scale.
Figure 4B:
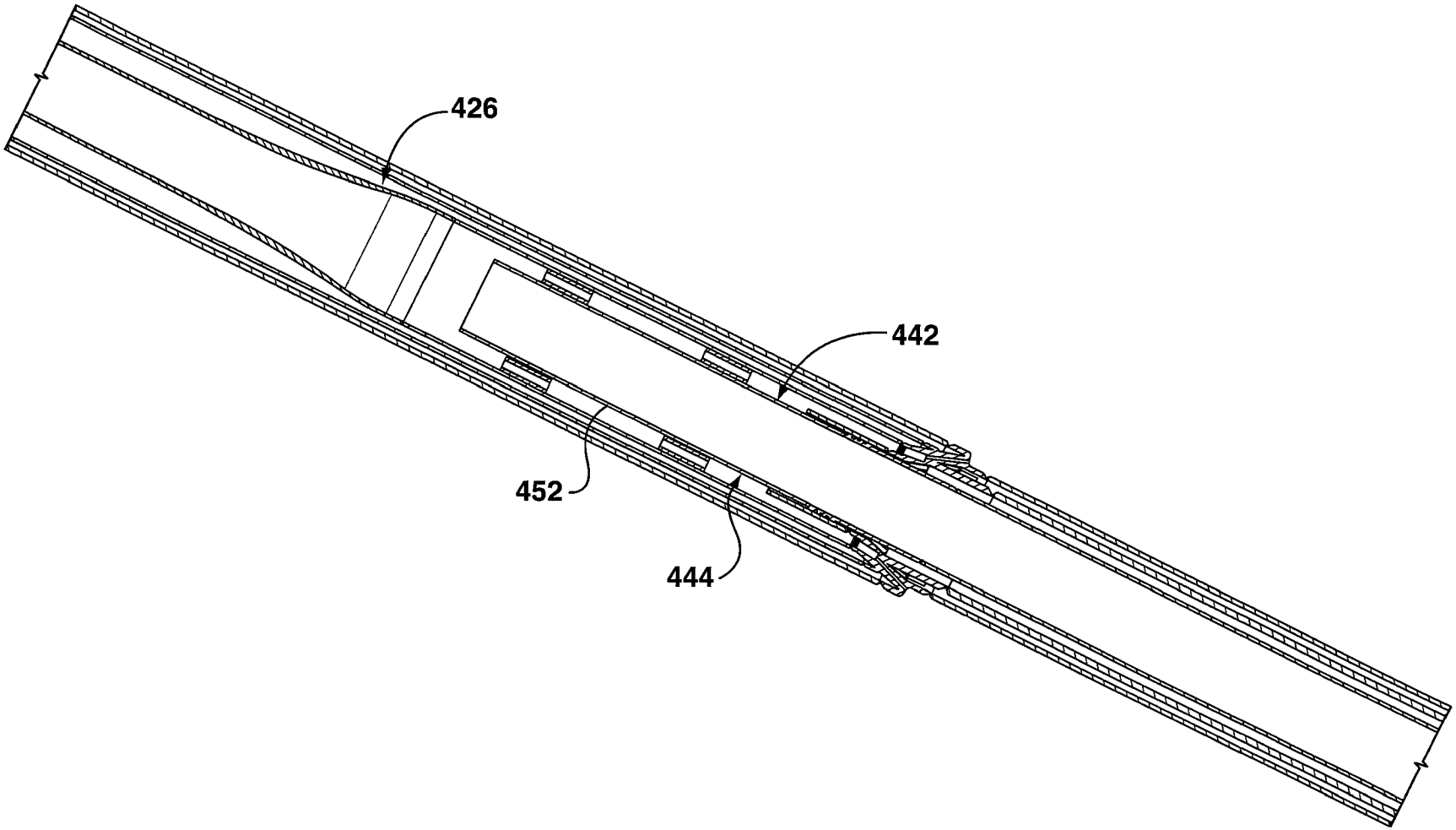
FIG. 4B is a cross-section of a portion of the post-combustion lance of FIG. 4A, drawn at a smaller scale.
Figure 4C:
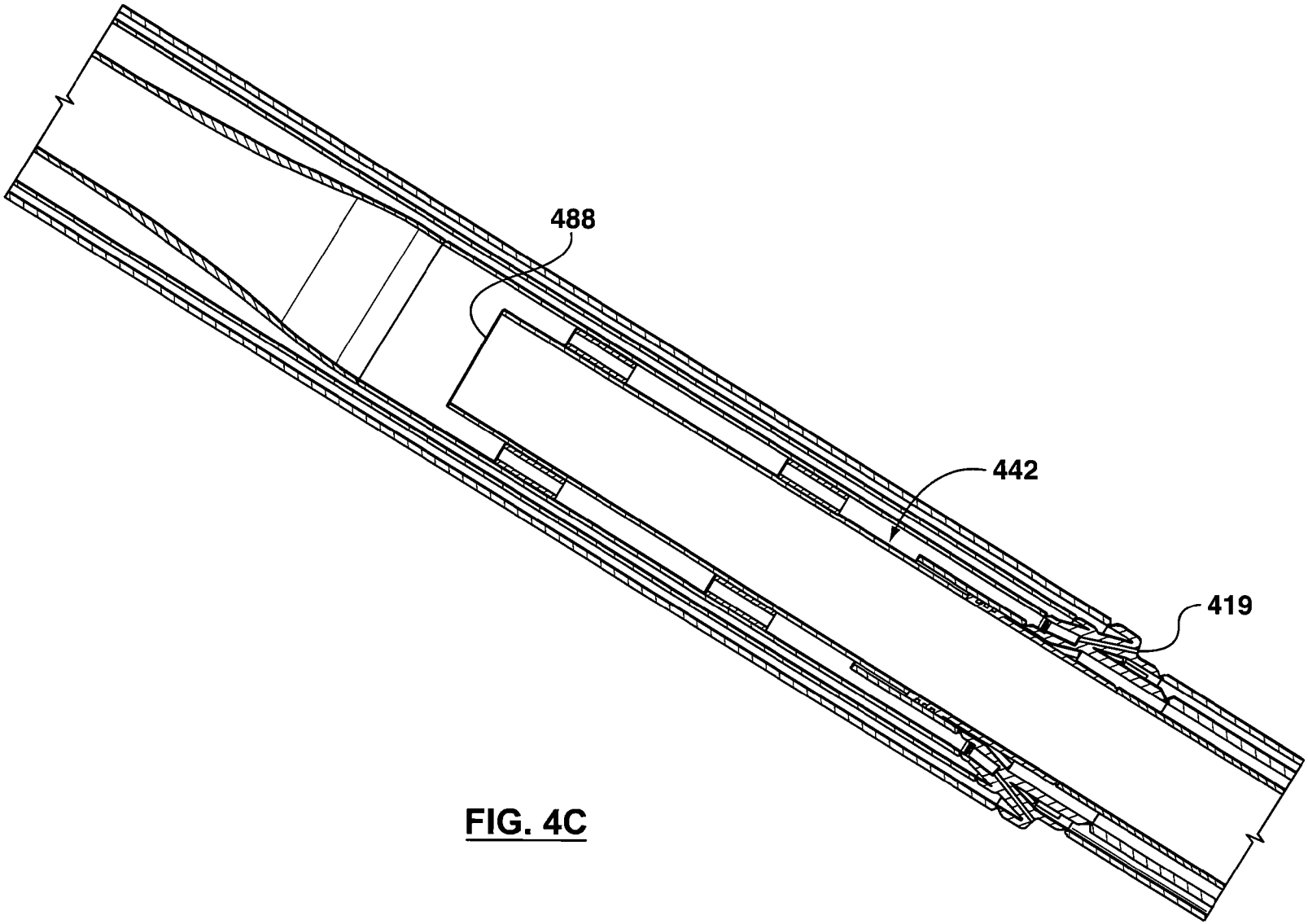
FIG. 4C is a cross-section of a portion of the post-combustion lance of FIG. 4B, drawn at a larger scale.

Another embodiment of the post-combustion lance 440 of the invention is disclosed in FIGS. 4A-4C. The post-combustion lance 440 includes a body 420 extending between an upstream end 412 and a downstream end 414 of the lance 440, the upstream end 412 being adapted to receive the gas. The downstream end 414 includes a primary tip 416 through which a first part of the gas exits the lance 440. The body 420 includes upper and lower portions 422, 424 and a post-combustion distributor 418 mounted therebetween at a predetermined distance from the primary tip 416. The lance 440 preferably also includes an upper inner tube 426 positioned at least partially upstream from the distributor 418 (FIG. 4B) and attached to the upper portion 422. In addition, the lance 440 includes an internal support assembly 442 for supporting the body 420 (FIGS. 4A-4C). In one embodiment, the internal support assembly 442 includes an internal tube 444 extending between a downstream end 487 thereof positioned proximal to the downstream end 414 of the lance 440, and to an upstream end 488 of the internal tube 444 positioned at least partially upstream relative to the ports 419 of the distributor 418. Preferably, the internal support assembly 442 additionally includes one or more collars 446 secured to the internal tube 444 and positioned between the upper inner tube 426 and the internal tube 444, to support the internal tube 444 in a predetermined position substantially coaxial with the upper inner tube 426 so that the internal tube 444 resists deflection of the body 420.

As can be seen in FIGS. 4B and 4C, the lance 440 does not include a lower inner tube in which a downstream portion of the internal tube 444 is slidingly engageable. The internal tube 444 preferably is mounted to the lower portion 424 at the downstream end 487 of the internal tube 444, using any suitable means. For example, the internal tube 444 may be welded to the lower portion 424 at any suitable location(s) thereon, i.e., the internal tube 444 may be welded to the lower portion 424 at the downstream end 487.

Figure 5A:
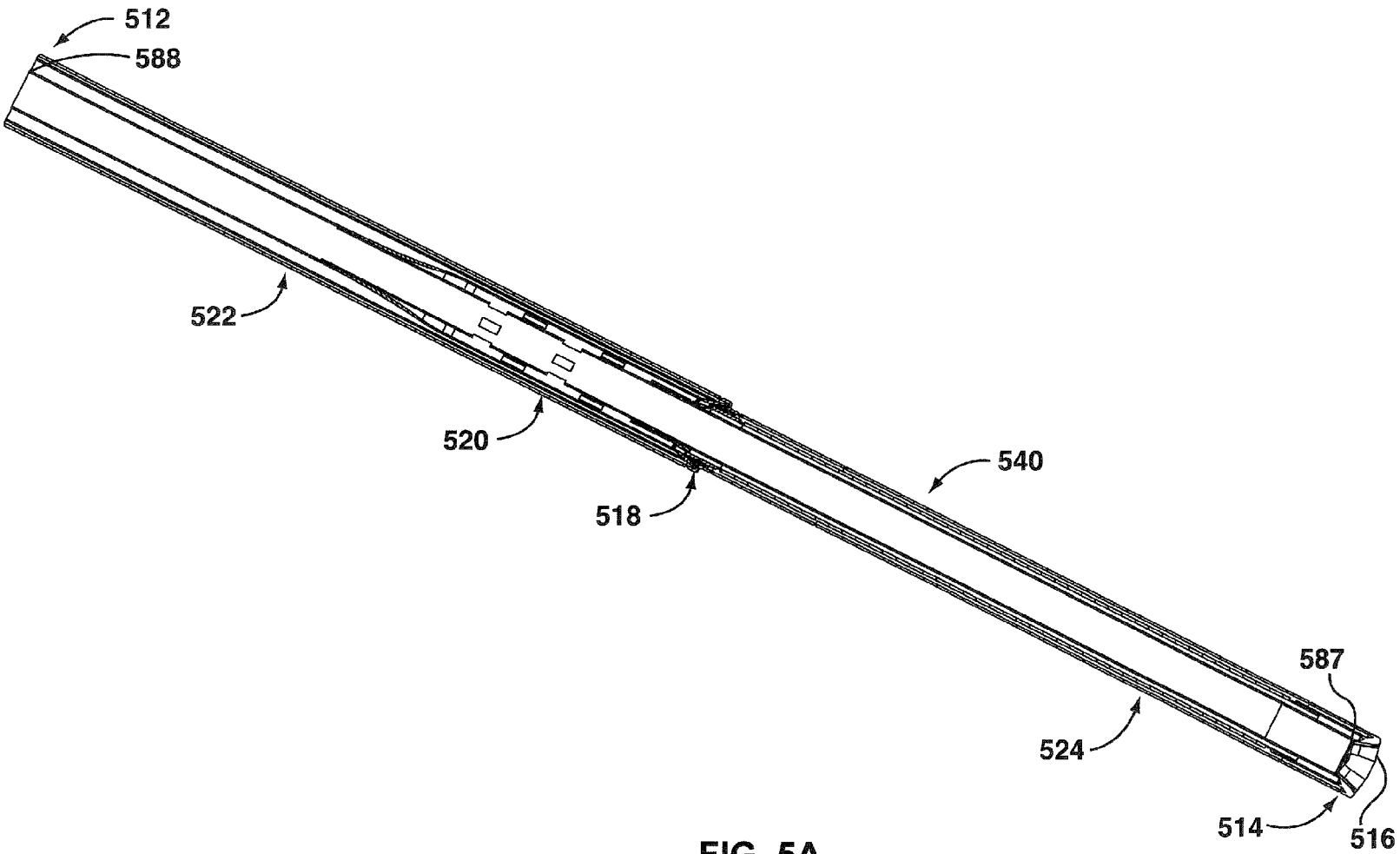
FIG. 5A is a cross-section of another embodiment of the post-combustion lance of the invention, drawn at a smaller scale.
Figure 5B:
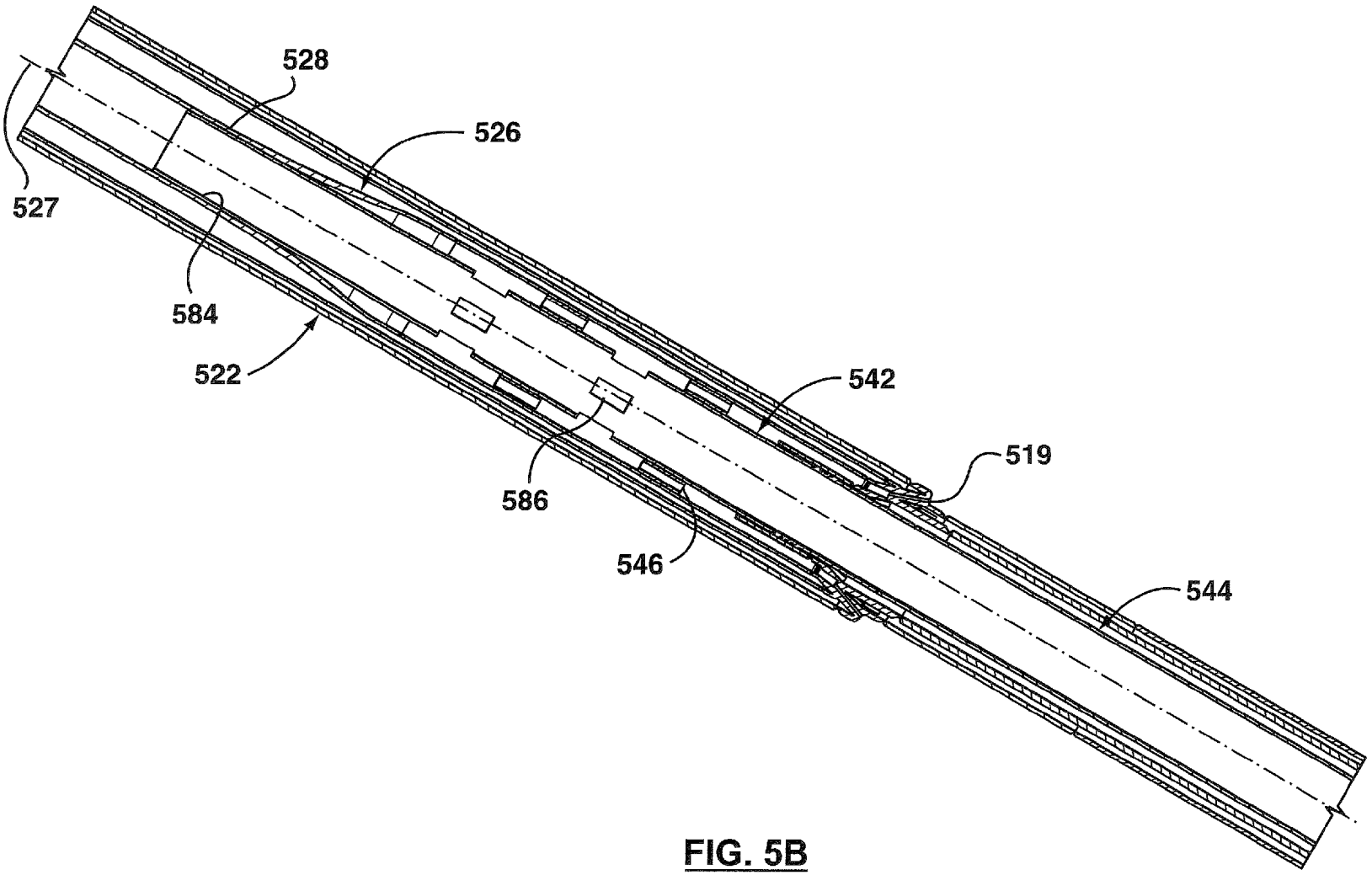
FIG. 5B is a cross-section of a portion of the post-combustion lance of FIG. 5A, drawn at a larger scale.
Figure 5C:
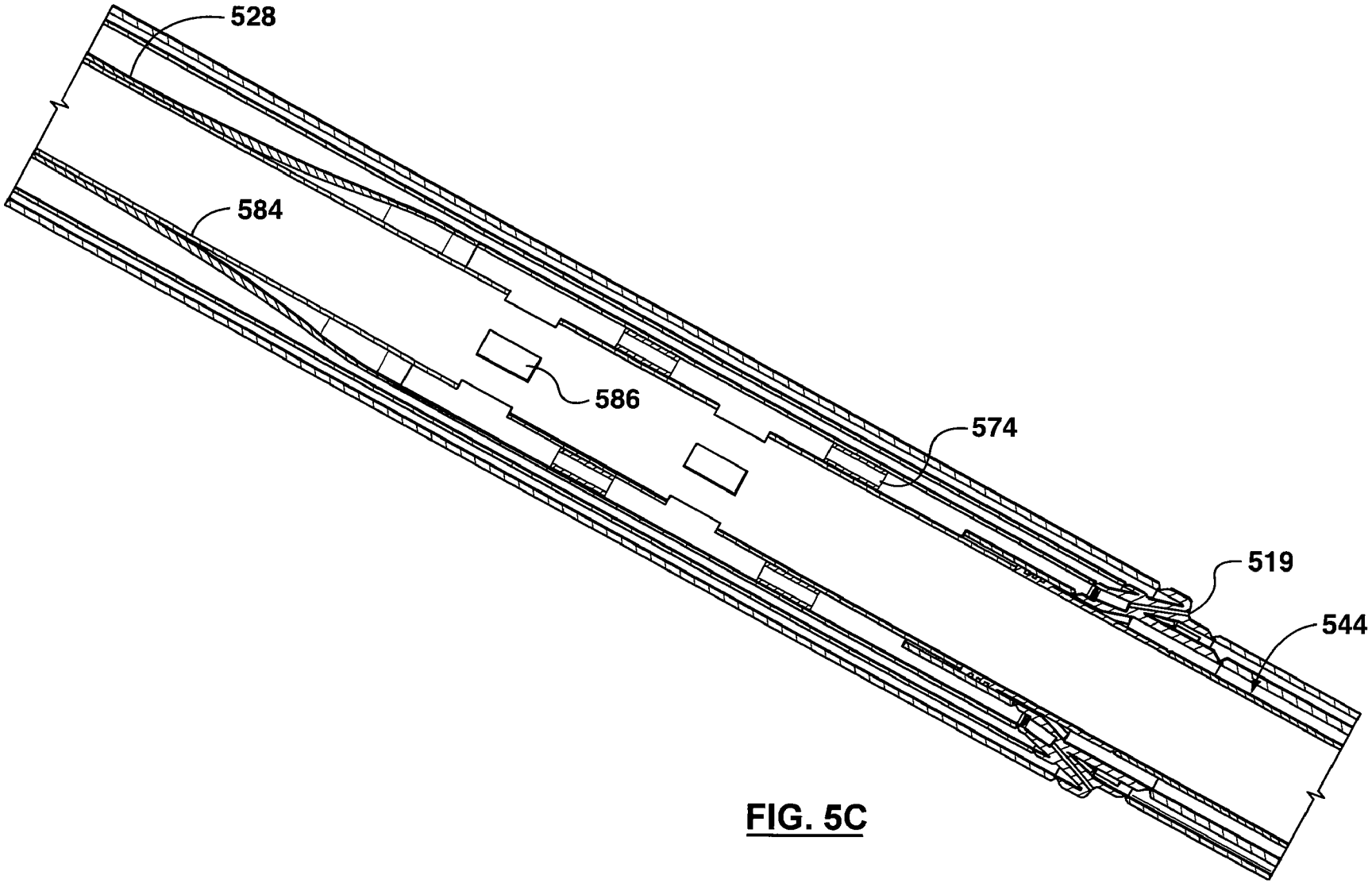
FIG. 5C is a cross-section of a portion of the post-combustion lance of FIG. 5B, drawn at a larger scale.

In FIGS. 5A-5C, another embodiment of the post-combustion lance 540 of the invention is shown. The post-combustion lance 540 includes a body 520 extending between an upstream end 512 and a downstream end 514 of the lance 540, the upstream end 512 being adapted to receive the gas. The downstream end 514 includes a primary tip 516 through which a first part of the gas exits the lance 540. The body 520 includes upper and lower portions 522, 524 and a post-combustion distributor 518 mounted therebetween at a predetermined distance from the primary tip 516. The lance 540 preferably also includes an upper inner tube 526 positioned at least partially upstream from the distributor 518 (FIG. 5B) and attached to the upper portion 522. In addition, the lance 540 includes an internal support assembly 542 for supporting the body 520. In one embodiment, the internal support assembly 542 includes an internal tube 544 extending between a downstream end 587 thereof positioned proximal to the downstream end 514 of the lance 540, and to an upstream end 588 of the internal tube 444.

As can be seen in FIGS. 5A-5C, in one embodiment, an upstream portion 584 preferably is engaged with an upstream portion 528 of the upper inner tube 526. Preferably, the internal support assembly 542 additionally includes one or more collars 546 secured to the internal tube 544 and positioned between the upper inner tube 526 and the internal tube 544, to support the internal tube 544 in a predetermined position substantially coaxial with the body 520 so that the internal tube 544 resists deflection of the body 520. The lance 540 does not include a lower inner tube in which a downstream portion of the internal tube 544 is slidingly engageable. The internal tube 544 preferably is engaged to the lower portion 524 of the internal tube 544, using any suitable means.

As shown in FIGS. 5A-5C, the internal tube 544 preferably also includes one or more apertures 586. The internal tube 544 is positioned in the body 520 so that the apertures 586 are at least partially upstream relative to the ports 519 in the distributor 518.

Figure 8A:
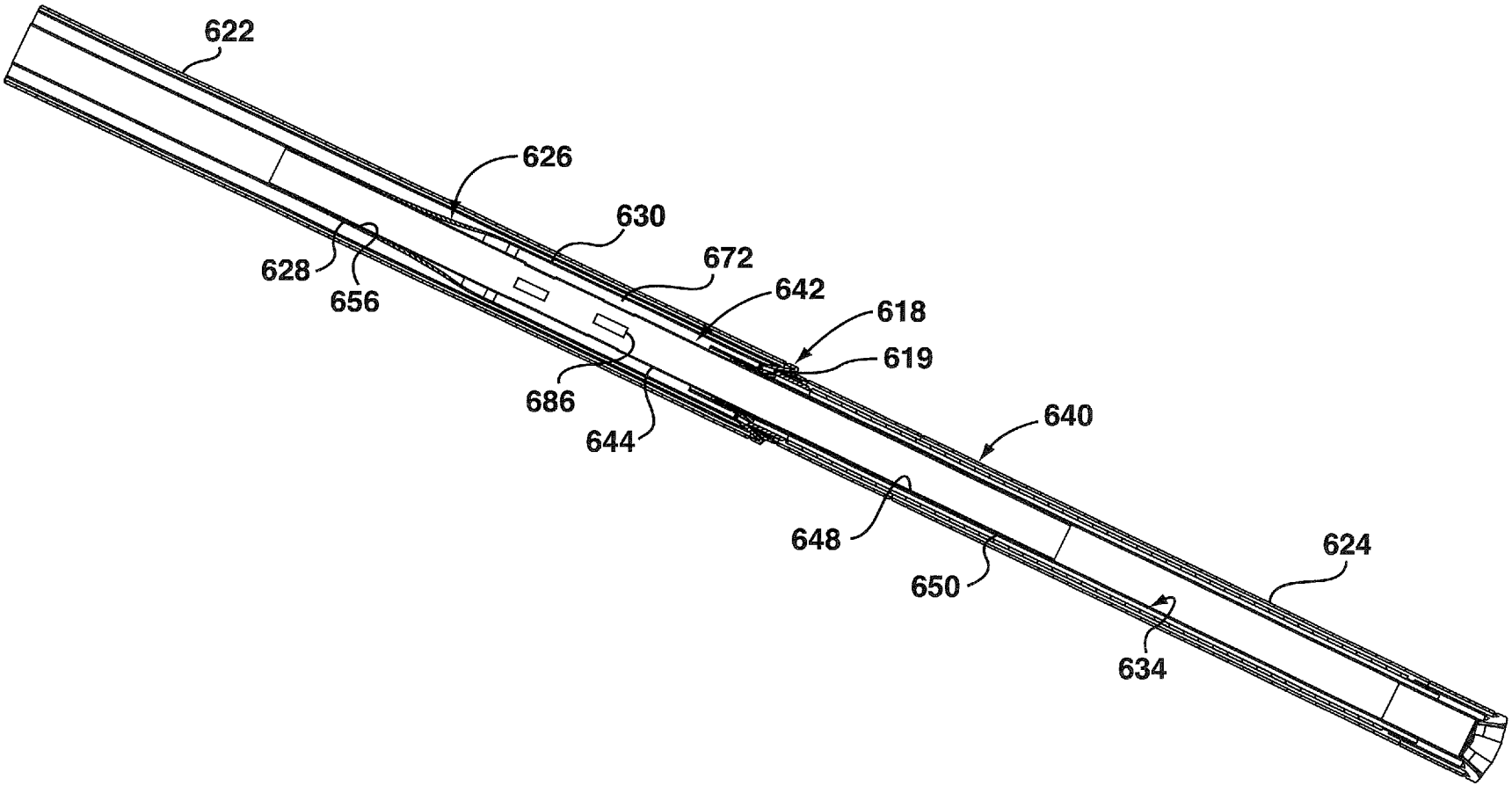
FIG. 8A is a cross-section of another embodiment of the lance of the invention.

Another alternative embodiment of the post-combustion lance 640 of the invention is disclosed in FIG. 8A. As can be seen in FIG. 8A, the lance 640 is similar to the lance 320 disclosed in FIGS. 3A-3C, except that the lance 640 does not include elements corresponding to the collars 346 in the lance 340.

In the lance 640, the internal support assembly 642 includes the internal tube 644, but does not include collars. As can be seen in FIG. 8A, the internal tube 644 includes an upstream portion 656 which is engaged in the upstream portion 628 of the upper inner tube 626. Similarly, a downstream portion 648 of the internal tube 644 is engaged with an upstream portion 650 of the lower inner tube 634. In this embodiment, the internal tube is secured to either the upper inner tube 626 or the lower inner tube 634, or both, in order to maintain the internal tube 644 in position. The internal tube 644 supports the body 620 of the lance, because the internal tube 644 is engaged with each of the upper inner tube 626 and the lower inner tube 634, at the internal tube's upstream and downstream portions 656, 648 respectively. An annulus 672 in fluid communication with the ports 619 of the distributor 618 is defined between the internal tube 644 and the downstream portion 630 of the upper inner tube 626. The internal tube 644 includes apertures 686 to permit the second part of the gas to flow from the upstream portion 628 of the upper inner tube 626 to the annulus 672.

Figure 8B:
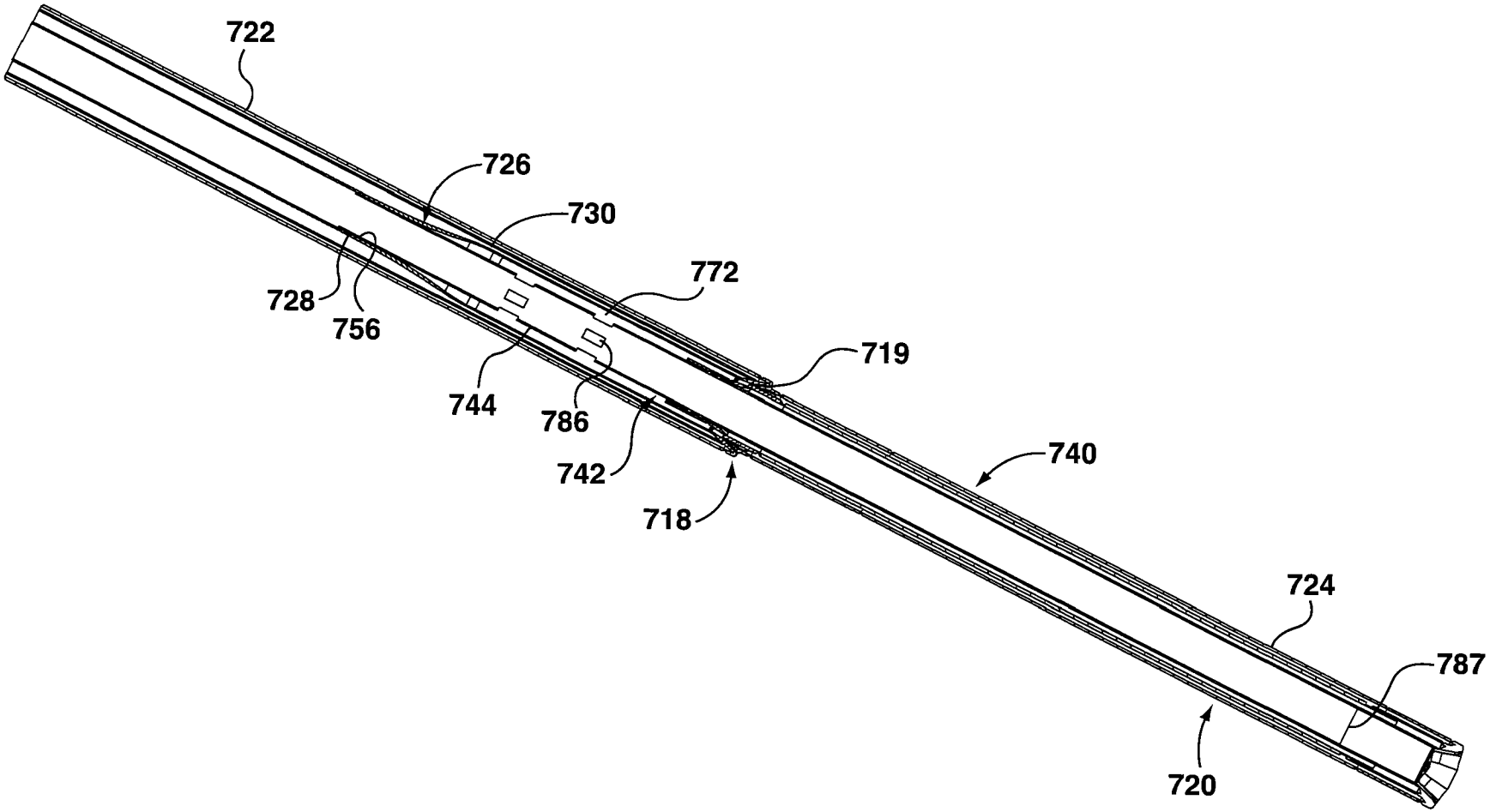
FIG. 8B is a cross-section of another alternative embodiment of the lance of the invention.

Another alternative embodiment of the post-combustion lance 740 of the invention is disclosed in FIG. 8B. The lance 740 is similar to the lance 640, except that the lance 740 does not include an element corresponding to the lower inner tube of the lance 640. The internal tube 744 includes a downstream end 787 which is secured to the lower portion 724 of the lance body 720 by any suitable means. The internal tube 744 also includes an upstream portion 756 which is engaged with an upstream portion 728 of the upper inner tube 726. Accordingly, the internal tube 744 supports the body 720.

An annulus 772 in fluid communication with the ports 719 of the distributor 718 is defined between the internal tube 744 and a downstream portion 730 of the upper inner tube 726. The internal tube 744 includes apertures 786 to permit the second part of the gas to flow from the upstream portion 728 to the annulus 772 which is defined between the internal tube 744 and a downstream portion 730 of the upper inner tube 726.

It will be appreciated by those skilled in the art that the invention can take many forms, and that such forms are within the scope of the invention as described above. The foregoing descriptions are exemplary, and their scope should not be limited to the preferred versions provided therein.

We claim:

1. An internal support assembly for supporting a body of a post-combustion lance extending between an upstream end in an upper portion and a downstream end in a lower portion, the lance being adapted to direct a gas at least partially therethrough, the lance comprising a primary tip at the downstream end from which a first part of the gas exits and a post-combustion distributor mounted between the upper and lower portions comprising a plurality of ports from which a second part of the gas exits, an upper inner tube positioned inside the body and at least partially upstream from the distributor, and a lower inner tube positioned inside the body and at least partially downstream from the distributor, the internal support assembly comprising:

an internal tube positionable inside the body and at least partially upstream relative to the lower inner tube;

the internal tube being engageable with the lower inner tube;

at least one collar securable to the internal tube and positionable between the upper inner tube and the internal tube, to maintain the internal tube in a predetermined position coaxial with the body such that the internal tube resists deflection of the body;

said at least one collar being securable to an outer wall of the internal tube and attachable to an inner wall of the upper inner tube, to position the internal tube substantially coaxially with the upper and lower inner tubes; and said at least one collar comprising at least one aperture therein to permit said second part of the gas to flow therethrough.

2. A post-combustion lance for directing a gas at least partially therethrough, the post-combustion lance comprising:

a body extending between an upstream end and a downstream end of the lance, the upstream end being adapted to receive the gas, and the downstream end comprising a primary tip through which a first part of the gas exits the lance;

the body comprising upper and lower portions and a post-combustion distributor mounted therebetween at a predetermined distance from the primary tip, the distributor comprising a plurality of ports through which a second part of the gas exits the lance;

an upper inner tube positioned at least partially upstream from the distributor and attached to the upper portion;

a lower inner tube positioned at least partially downstream from the distributor and attached to the lower portion;

an internal support assembly for supporting the body, the internal support assembly comprising:

an internal tube positioned inside the body and at least partially upstream relative to the lower inner tube;

the internal tube being engaged with the lower inner tube;

a plurality of collars positioned between the upper inner tube and the internal tube, to support the internal tube in a predetermined position coaxial with the body such that the internal tube resists deflection of the body; and each said collar being secured to an outer wall of the internal tube and at least one of said collars being attached to an inner wall of the upper inner tube, to position the internal tube substantially coaxially with the body.

3. A post-combustion lance for directing a gas at least partially therethrough, the post-combustion lance comprising:

a body extending between an upstream end and a downstream end of the lance, the upstream end being adapted to receive the gas, and the downstream end comprising a primary tip through which a first part of the gas exits the lance;

the body comprising upper and lower portions and a post-combustion distributor mounted therebetween at a predetermined distance from the primary tip, the distributor comprising a plurality of ports through which a second part of the gas exits the lance;

an upper inner tube positioned at least partially upstream from the distributor and attached to the upper portion;

a lower inner tube positioned at least partially downstream from the distributor and attached to the lower portion;

an internal support assembly for supporting the body, the internal support assembly comprising:

an internal tube positioned inside the body and at least partially upstream relative to the lower inner tube;

the internal tube being engaged with the lower inner tube;

a plurality of collars positioned between the upper inner tube and the internal tube, to support the internal tube in a predetermined position coaxial with the body such that the internal tube resists deflection of the body;

the upper inner tube comprising:

an upstream portion proximal to the upstream end, the upstream portion being substantially cylindrical and having outer and inner diameters;

a downstream portion proximal to the distributor, the downstream portion having an outer diameter larger than the outer diameter of the upstream portion and an inner diameter larger than the inner diameter of the upstream portion;

a connecting portion connecting the upstream and downstream portions;

the internal tube comprising an outer diameter smaller than the inner diameter of the downstream portion such that an annulus is defined between the internal tube and the downstream portion;

the annulus being in fluid communication with said ports; and said at least one collar comprising at least one aperture therein to permit said second part of the gas to flow therethrough.

4. The post-combustion lance according to claim 3 in which the internal tube additionally comprises an upstream portion engaged with the upstream portion of the upper inner tube, for supporting the body.

5. The post-combustion lance according to claim 4 in which the internal tube additionally comprises at least one aperture positioned at least partially upstream relative to the distributor to permit the second part of the gas to flow to the annulus from the upstream portion of the upper inner tube.

6. The post-combustion lance according to claim 3 in which the internal tube comprises an upstream portion engaged with the upstream portion of the upper inner tube, for resisting deflection of the body of the lance.

7. A post-combustion lance for directing a gas at least partially therethrough, the post-combustion lance comprising:

a body extending between an upstream end and a downstream end of the lance, the upstream end being adapted to receive the gas, and the downstream end comprising a primary tip through which a first part of the gas exits the lance;

the body comprising upper and lower portions and a post-combustion distributor mounted therebetween at a predetermined distance from the primary tip, the distributor comprising a plurality of ports through which a second part of the gas exits the lance;

an upper inner tube positioned at least partially upstream from the distributor and attached to the upper portion, the upper inner tube comprising:

an upstream portion proximal to the upstream end, the upstream portion being substantially cylindrical and having outer and inner diameters;

a downstream portion proximal to the distributor, the downstream portion having an outer diameter substantially larger than the outer diameter of the upstream portion and an inner diameter substantially larger than the inner diameter of the upstream portion;

a connecting portion connecting the upstream and downstream portions;

a lower inner tube positioned at least partially downstream from the distributor and attached to the lower portion;

an internal support assembly for supporting the body, the internal support assembly comprising:

an internal tube positioned inside the body and at least partially upstream relative to the lower inner tube;

the internal tube being engaged with the lower inner tube;

the internal tube comprising an outer diameter smaller than the inner diameter of the downstream portion such that an annulus is defined between the internal tube and the downstream portion;

the annulus being in fluid communication with said ports;

the internal tube comprising an upstream portion engaged with the upstream portion of the upper inner tube, for supporting the body; and the internal tube comprising at least one aperture positioned at least partially upstream relative to the distributor to permit the second part of the gas to flow to the annulus from the upstream portion of the upper inner tube.

8. A post-combustion lance for directing a gas therethrough, the post-combustion lance comprising:

a body extending between an upstream end and a downstream end of the lance, the upstream end being adapted to receive the gas under pressure, and the downstream end comprising a primary tip through which a first part of the gas exits the lance;

the body comprising upper and lower portions and a post-combustion distributor mounted therebetween at a predetermined distance from the primary tip, the distributor comprising a plurality of ports through which a second part of the gas exits the lance;

an upper inner tube positioned at least partially upstream from the distributor and attached to the upper portion;

an internal support assembly for supporting the body, the internal support assembly comprising:

an internal tube extending between a downstream end thereof positioned proximal to the downstream end of the lance, and an upstream end of the internal tube positioned at least partially upstream relative to the ports of the distributor;

the internal tube comprising an outer diameter smaller than the inner diameter of the downstream portion such that an annulus is defined between the internal tube and the downstream portion;

the annulus being in fluid communication with said ports;

the internal tube comprising an upstream portion engaged with the upstream portion of the upper inner tube, for supporting the body; and the internal tube comprising at least one aperture positioned at least partially upstream relative to the distributor to permit the second part of the gas to flow to the annulus from the upstream portion of the upper inner tube.

9. An internal support assembly for supporting a body of a post-combustion lance extending between an upstream end in an upper portion and a downstream end in a lower portion, the lance being adapted to direct a gas at least partially therethrough, the lance comprising a primary tip at the downstream end from which a first part of the gas exits and a post-combustion distributor mounted between the upper and lower portions comprising a plurality of ports from which a second part of the gas exits, an upper inner tube positioned inside the body and at least partially upstream from the distributor, and a lower inner tube positioned inside the body and at least partially downstream from the distributor, the internal support assembly comprising:

an internal tube positionable inside the body and at least partially upstream relative to the lower inner tube;

the internal tube being engageable with the lower inner tube;

at least one collar securable to the internal tube and positionable between the upper inner tube and the internal tube, to maintain the internal tube in a predetermined position coaxial with the body such that the internal tube resists deflection of the body; and said at least one collar comprising at least one aperture therein to permit said second part of the gas to flow therethrough.

10. A post-combustion lance for directing a gas therethrough, the post-combustion lance comprising:

a body extending between an upstream end and a downstream end of the lance, the upstream end being adapted to receive the gas under pressure, and the downstream end comprising a primary tip through which a first part of the gas exits the lance;

the body comprising upper and lower portions and a post-combustion distributor mounted therebetween at a predetermined distance from the primary tip, the distributor comprising a plurality of ports through which a second part of the gas exits the lance;

an upper inner tube positioned at least partially upstream from the distributor and attached to the upper portion;

an internal support assembly for supporting the body, the internal support assembly comprising:

an internal tube extending between a downstream end thereof positioned proximal to the downstream end of the lance, and an upstream end of the internal tube positioned at least partially upstream relative to the ports of the distributor; and at least one collar secured to the internal tube and positioned between the upper inner tube and the internal tube, to support the internal tube in a predetermined position substantially coaxial with the upper inner tube such that the internal tube resists deflection of the body, in which the at least one collar comprises at least one aperture therein to permit said second part of the gas to flow therethrough.

11. The post-combustion lance according to claim 10 in which the internal tube comprises an upstream portion engaged with an upstream portion of the upper inner tube, for resisting deflection of the body of the lance.

* * * * *